US005731122A

United States Patent [19]

Yoshida et al.

[11] Patent Number: 5,731,122

[45] Date of Patent: Mar. 24, 1998

[54] IMAGE FORMING METHOD AND IMAGE FORMING APPARATUS

[75] Inventors: Satoshi Yoshida, Tokyo; Motoo Urawa, Funabashi; Shuichi Aita; Tsutomu Kukimoto, both of Yokohama; Yoshifumi Hano, Inagi; Yuki Nishio, Kawasaki, all of Japan

[73] Assignee: Canon Kabushiki Kaisha, Tokyo, Japan

[21] Appl. No.: 555,341

[22] Filed: Nov. 8, 1995

[30] Foreign Application Priority Data

Nov. 8, 1994 [JP] Japan ..... 6-298019
Nov. 9, 1994 [JP] Japan ..... 6-299073

[51] Int. Cl.[6] ..... G03G 13/16

[52] U.S. Cl. ..... 430/126; 399/346; 430/125

[58] Field of Search ..... 430/106, 106.6, 430/108, 110, 126; 399/346

[56] References Cited

U.S. PATENT DOCUMENTS

| | | | |
|---|---|---|---|
| 4,030,921 | 6/1977 | Akira et al. | 96/1.5 |
| 4,265,998 | 5/1981 | Barkley | 430/125 |
| 4,957,840 | 9/1990 | Sakashita et al. | 430/106.6 |
| 4,985,327 | 1/1991 | Sakashita et al. | 430/106.6 |
| 5,137,796 | 8/1992 | Takiguchi et al. | 430/106.6 |
| 5,139,914 | 8/1992 | Tomiyama et al. | 430/106.6 |
| 5,202,213 | 4/1993 | Nakahara et al. | 430/110 |
| 5,215,845 | 6/1993 | Yusa et al. | 430/106.6 |
| 5,253,023 | 10/1993 | Hosaka et al. | 355/279 |
| 5,262,267 | 11/1993 | Takiguchi et al. | 430/102 |
| 5,485,250 | 1/1996 | Kashimura et al. | 430/66 |

FOREIGN PATENT DOCUMENTS

| | | |
|---|---|---|
| 0330498 | 8/1989 | European Pat. Off. . |
| 0395026 | 10/1990 | European Pat. Off. . |
| 0578094 | 1/1994 | European Pat. Off. . |
| 0660199 | 6/1995 | European Pat. Off. . |
| 0677794 | 10/1995 | European Pat. Off. . |
| 2551306 | 8/1976 | Germany . |
| 59-133573 | 7/1984 | Japan . |
| 62-203182 | 9/1987 | Japan . |
| 63-133179 | 6/1988 | Japan . |
| 64-20587 | 1/1989 | Japan . |
| 1-112253 | 4/1989 | Japan . |
| 1-191156 | 8/1989 | Japan . |
| 2-51168 | 2/1990 | Japan . |
| 2-214156 | 8/1990 | Japan . |
| 2-284158 | 11/1990 | Japan . |
| 2-302772 | 12/1990 | Japan . |
| 3-181952 | 8/1991 | Japan . |
| 4-162048 | 6/1992 | Japan . |
| 5-53482 | 3/1993 | Japan . |
| 5-61383 | 3/1993 | Japan . |
| 5-188752 | 7/1993 | Japan . |
| 5-188765 | 7/1993 | Japan . |

OTHER PUBLICATIONS

Hosaya et al., "Contact–type Development System . . . ", Japan Hardcopy '89 Ann. Conf. Japan Hardcopy for Soc. of Elect. of Japan, Jul. 1989, pp. 25–29.

Watanabe et al., "Compact Page Printer", Fujitsu Sci. Tech. J., vol. 28, No. 4, pp. 473–480, Dec. 1992.

*Primary Examiner*—John Goodrow

*Attorney, Agent, or Firm*—Fitzpatrick, Cella, Harper & Scinto

[57] ABSTRACT

An image forming method and image forming apparatus for charging a photosensitive member, exposing the charged photosensitive member thereby forming an electrostatic latent image, carrying toner with a toner carrying member to bring the toner into contact with the photosensitive member surface, thereby developing the electrostatic latent image and forming a toner image upon the photosensitive member, transferring the toner image that is on the photosensitive member to transfer material such as paper, and conducting a simultaneous developing-cleaning process which recovers residual toner remaining on the photosensitive member following the transfer process, so that toner consumption is greatly reduced and high image quality is maintained at the same time. The angle of contact of the photosensitive member surface to water is 85° or greater, the toner is comprised of at least toner particles possessing binder resin and coloring agent, and an inorganic fine powder, and the toner has an average particle diameter by volume DV (μm) of 3 μm≦DV≦8 μm, an average particle diameter by weight D4 (μm) of 3.5 μm≦D4≦9 μm, and the ratio Nr of particles having a particle diameter smaller than 5 μm in particle diameter distribution by number of 17% by number≦Nr≦90% by number.

53 Claims, 11 Drawing Sheets

GHOST EVALUATION PATTERN WITH A4-SIZED PAPER

IMAGE FORMING METHOD AND IMAGE FORMING APPARATUS

BACKGROUND OF THE INVENTION

1. Field of the Invention

The present invention relates to an image forming method and an image forming apparatus applied to printers, copying machines, facsimile machines, etc. In more detail, the present invention relates to an image forming method and an image forming apparatus applied to printers, copying machines, facsimile machines, etc., in which the development of electrostatic latent images and collection of residual toner after transfer are effected by the same means.

2. Related Background Art

A number of methods are hitherto known as electrophotography, in which, in general, electrostatic latent images are formed on a photosensitive member (image bearing member) using photoconductive material and various means, subsequently the electrostatic latent images are developed with toner to form toner images which are transferred to a transfer medium such as paper if necessary, followed by fixing the toner images on the transfer medium by heat, pressure or heating and pressing, and producing copies or prints.

As methods for visualizing electrostatic latent images, cascade, magnetic brush and pressing developing methods, etc. are all well known. In addition, a method is known in which a magnetic toner and a rotary sleeve are used and the magnetic toner on the sleeve is attracted to a photosensitive member in an electric field.

Unlike a two-component developing system, a one-component system does not require carrier particles such as glass beads or iron powder and hence, the developing apparatus itself can be made smaller and lighter. In addition, since with the two-component system the toner concentration in the developer should be held constant, an apparatus is necessary for detecting the toner concentration and supplying the toner. Thus the developing apparatus becomes larger and heavier. With the one-component developing system, since such an apparatus is not necessary, it enables the developing apparatus to become smaller and lighter.

Recently, LBP printers and LED printers are the most common printing apparatus using electrophotography. Technique in the art is oriented toward 400, 600 and 800 dpi from conventional 240 and 300 dpi, i.e., toward higher resolution. As a consequence of higher resolution, a highly accurate developing system is required. As copying machines become more functional, they have become digitized. According to such an orientation, electrostatic latent images are mainly formed by the use of a laser in order to enhance resolution. Copying machines as well as printers are thus required to be highly accurate. For the above reason, the toner particle diameter tends to be increasingly smaller. And toners each having a small particle diameter in the specific distribution of particle size are suggested in Japanese Patent Application Laid-Open No. Hei 1-112253, Japanese Patent Application Laid-Open No. Hei 1-191156, Japanese Patent Application Laid-Open No. Hei 2-214156, Japanese Patent Application Laid-Open No. Hei 2-284158, Japanese Patent Application Laid-Open No. Hei 3-181952, and Japanese Patent Application Laid-Open No. Hei 4-162048.

In recent years, a one-component contact developing method has been suggested in which development is carried out by pressing a semi-conductive developing roller or a developing roller on the surface of which a dielectric layer is formed, against the surface of a photosensitive member. The technique directed to such a one-component contact developing method is described in, for example, "Japan Hardcopy 1989 Article Collection, pages 25–28", "FUJITSU Sci. Tech. J., 28, 4, pages 473–480", Japanese Patent Application Laid-Open No. Hei 5-188765 and Japanese Patent Application Laid-Open No. Hei 5-188752.

The contact one-component developing method has an advantage in that since the surface of a photosensitive member and a developing electrode are disposed very closely, the edge effect on development can be reduced.

Under the circumstances of the raised consciousness concerning resource saving, toner consumption (the toner amount used when the image area is set constant) is required to be furthermore reduced.

The means conventionally used in the cleaning step of a photosensitive member may be exemplified by blade, fur brush and roller cleaning. By these means, the residual toner after tranfer is physically scraped off a photosensitive member, collected and stored in a waste toner container. Therefore, problems are liable to rise due to the pressing of members constituting such a means against the photosensitive member surface. For example, the strong pressing of a cleaning member abrades the photosensitive member surface. In addition, the provided cleaning means inevitably leads to the enlargement of the whole apparatus, which becomes an obstacle when the apparatus is to be miniaturized. Further, from the viewpoint of ecology, an apparatus which does not discharge waste toner has been eagerly anticipated.

As described in Japanese Patent Application Laid-Open No. Hei 2-51168, the technique which is conventionally called "cleaning simultaneous with developing" or "cleanerless" focuses on positive memory or negative memory of toner images due to the residual toner remaining after transfer. However, since electrophotography nowadays is used for various purposes, toner images are required to be transferred to a variety of transfer mediums. From such a viewpoint, the prior arts are not satisfactory.

In Japanese Patent Application Laid-Open No. Hei 2-51168, it is described that spherical toner and a spherical carrier are used in a cleanerless electrophotograph printing method to impart stable chargeability. However, in that document there is no reference to the distribution of particle size. In addition, while techniques relating to the cleanerless type is described in Japanese Patent Application Laid-Open No. Sho 59-133573, Japanese Patent Application Laid-Open No. Sho 62-203182, Japanese Patent Application Laid-Open No. Sho 63-133179, Japanese Patent Application Laid-Open No. Sho 64-20587, Japanese Patent Application Laid-Open No. Hei 2-302772, Japanese Patent Application Laid-Open No. Hei 5-53482 and Japanese Patent Application Laid-Open No. Hei 5-61383, the constitution of a photosensitive member suitable for the cleanerless technique is not mentioned.

The edge effect may be inhibited by bringing a photosensitive member and a toner bearing member very close to each other, but it is very difficult to set the distance between the photosensitive member and the toner bearing member smaller than the toner layer thickness on the toner bearing member.

When the toner bearing member is pressed against the photosensitive member in order to inhibit the edge effect, if the surface moving rate of the toner bearing member is the same as the surface moving rate of the photosensitive member, electrostatic latent images on the photosensitive member are difficult to develop with toner to produce good toner images. If there is a difference between their surface moving rates, the toner on the toner bearing member is transferred to the photosensitive member corresponding to the electrostatic latent images and the toner images which are very faithful to the electrostatic latent images and free from the edge effect can be produced. However, the conventional contact developing method is not sufficient to efficiently recover the residual toner remaining after transfer simultaneously with developing.

The conventional cleaning method simultaneous with developing or the cleanerless image forming method may not perform sufficiently for various kinds of tranfer mediums such as cardboard and trasparent film for overhead projectors.

An object of the present invention is to provide an image forming method and an image forming apparatus in which the aforementioned problems of the prior arts have been resolved.

Another object of the present invention is to provide an image forming method and an image forming apparatus which have a constitution for cleaning simultaneous with developing and free from the influence of positive or negative memory due to the residual toner remaining after transfer.

Still another object of the present invention is to provide an image forming method and an image forming apparatus which enable systems to be designed having good transferability onto various kinds of transfer mediums such as cardboard and transparent film for overhead projectors.

A further object of the present invention is to provide an image forming method and apparatus which enable toner consumption to be reduced as compared with conventional method.

Yet another object of the present invention is to provide an image forming method and apparatus which can produce images having high density with the images being clear and sharp even with respect to small spot latent images.

One more object of the present invention is to provide an image forming method and apparatus in which electrostatic latent images are formed on a photosensitive member and, when the electrostatic latent images are developed, toner on a toner bearing member is in contact with the photosensitive member, wherein the toner is inhibited from deteriorating.

Still one more object of the present invention is to provide an image forming method and apparatus wherein the surface of a toner bearing member is inhibited from deteriorating.

Further one more object of the present invention is to provide an image forming method and apparatus which enable the speedup of a developing apparatus.

Yet one more object of the present invention is to provide an image forming method and apparatus in which a photosensitive member with resistance to deterioration is used.

SUMMARY OF THE INVENTION

It has been discovered that the foregoing objects can be realized by providing an image forming method which is primarily comprised of the steps:

a charging step of charging a photosensitive member;

an exposing step of subjecting the photosensitive member to light exposure to form an electrostatic latent image;

a developing step of bringing a toner carried on the surface of a toner bearing member into contact with the surface of the photosensitive member to form a toner image on the photosensitive member;

a transferring step of transferring the toner image on the photosensitive member to a transfer medium; and a cleaning step, which is carried out simultaneously with the transferring step, of recovering onto the toner bearing member a residual toner remaining on the photosensitive member after transfer, wherein the surface of the photosensitive member is of a contact angle of 85° or more with respect to water, and the toner has toner particles containing a binder resin and a coloring agent and an inorganic powder, and the toner has a volume average particle diameter ($D_v$ μm) of 3 μm$\leqq D_v \leqq$8 μm, a weight average diameter ($D_4$ μm) of 3.5 μm$\leqq D_4 \leqq$9 μm, and a ratio of particles having a particle diameter of 5 μm or smaller in a particle size distribution by number ($N_r$) of 17 number %$\leqq N_r \leqq$90 number %.

The present invention also provides an image forming method which is primarily comprised of:

a charging means for charging a photosensitive member;

and exposing means for subjecting the photosensitive member to light exposure to form an electrostatic latent image;

a developing means for bringing a toner carried on the surface of a toner bearing member into contact with the surface of the photosensitive member to form a toner image on the photosensitive member; and a transferring means for transferring the toner image on the photosensitive member onto a transfer medium, wherein the transferring means also has a function as a cleaning means for cleaning a residual toner remaining on the photosensitive member after transferring the toner image on the photosensitive member onto the transfer medium, the surface of the photosensitive member has a contact angle of 85° or more with respect to water, and the toner has toner particles containing a binder resin and a coloring agent and an inorganic powder, and the toner has a volume average particle diameter ($D_v$ μm) of 3 μm$\leqq D_v \leqq$8 μm, a weight average diameter ($D_4$ μm) of 3.5 μm$\leqq D_4 \leqq$9 μm, and a ratio of particles having a particle diameter of 5 μm or smaller in a particle size distribution by number ($N_r$) of 17 number %$\leqq N_r \leqq$90 number %.

DETAILED DESCRIPTION OF THE PREFERRED EMBODIMENT

Figure 1:
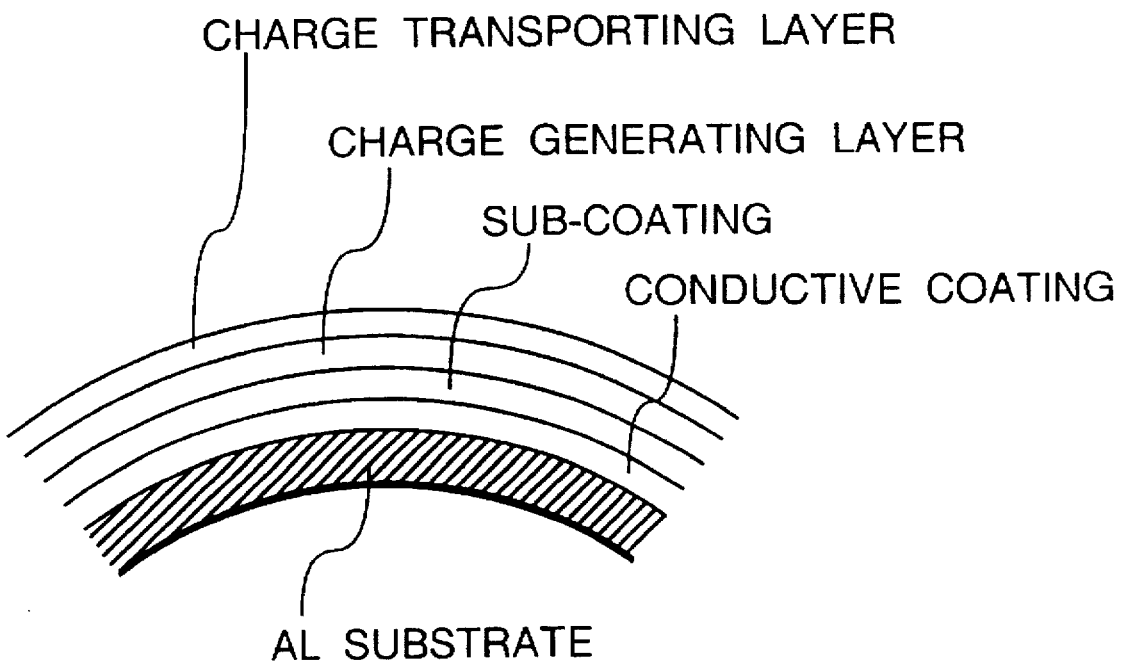
FIG. 1 is a partial cross-sectional view of a photosensitive member.

The present invention employs a photosensitive member possessing a surface with high releasability, thereby reducing the friction between the photosensitive member and toner or toner carrying member, preventing deterioration of toner due to prolonged usage, obtaining high resolution and preventing deterioration of the toner carrying member surface.

Further, the present invention employs a photosensitive member possessing a surface with high releasability, thereby enabling drastic reduction of the amount of a residual toner remaining after transfer and inhibiting production of negative ghost images because of no shading due to the residual toner, and also increasing the cleaning efficiency of the residual toner in developing, so that production of positive ghost images can be inhibited well.

The mechanism of ghost image production is described as follows: shading due to the residual toner after transfer raises a problem in the case where a photosensitive member (e.g., photosensitive drum or photosensitive belt) surface is repeatedly used for one sheet of transfer material. If the circumference of the photosensitive member is shorter than the length of the transfer material in the direction in which the transfer material is being fed, the photosensitive member must be subjected to the next charge-exposure-developing process in the state of having a residual toner remaining on it after transfer, while a sheet of transfer material passes through. As a result, developing contrast may be insufficient, because the potential is not sufficiently cleared from the photosensitive surface with the residual toner. In the case of inverse developing, when the residual toner is present, negative ghosts, the density of which is lower than that of the surrounding area, appears on images. If removal of the residual toner is insufficient at the time of developing, toner further adheres to the photosensitive member surface on which the residual toner is present, thereby causing positive ghosts of which density is higher than the surrounding area. The present invention is capable of favorably control the ghost image production, owing to the use of a specific photosensitive member and specific toner.

The present invention is effective in the case where the photosensitive member surface is constructed mainly of polymer binding agents, for example, where providing a protective film composed mainly of resin upon an inorganic photosensitive member such as selenium or amorphous silicon; having a surface layer formed of charge transporting agent and resin, as the charge transporting layer of a function separation type organic photosensitive member; and providing a protective layer upon a charge transporting layer.

The following means can be listed as means for imparting releasability to such outermost layer: (i) employ a resin with low surface energy as the resin forming the outermost layer itself: (ii) add an additive to the outermost layer to impart water repellent properties or lipophilic properties thereto; (iii) pulverize a material possessing high releaseability and disperse the material into the outermost layer. In the case of (i), this can be carried out by introducing chlorine-containing radicals and/or silicon-containing radicals into the structure of the resin. In the case of (ii), this can be carried out by employing a surfactant as an additive. In the case of (iii), compounds containing fluorine atoms (e.g., polytetrafluoroethylene, poly-vinylidene fluoride, carbon fluoride, etc.) can be named as the material. Of these, polytetrafluoroethylene powder is particularly preferred. In the present invention, it is preferred to disperse a powder with high releasability, such as a fluorine-containing resin, into the outermost layer.

By employing the above means, the contact of angle of the photosensitive member surface to water can be made to be 85° or greater, (preferably 90° or greater). If this angle is less than 85°, a lowering of the toner transfer rate and the deterioration of toner and a toner carrying member are liable to occur.

In order to cause the outermost layer to contain such powders, a layer of the powder dispersed within binder resin is formed upon the outermost surface of the photosensitive member. Alternatively, if the photosensitive member is an OPC photosensitive member originally comprised mainly of resin, the powder can be dispersed into the outermost layer, without providing a new layer. The amount to be added is 1 to 60% by weight based on the total weight of the outermost layer, preferably 2 to 50% by weight. When less than 1% by weight, the reduction of the residual toner is not sufficient, the transfer residual toner is difficult to remove, reducing the effect on inhibition of the ghost, and also reducing the toner recovery efficiency in the developing process. When more than 60% by weight, the strength of the outermost layer is lowered, and the incident light quantity to the photosensitive member decreases, which is not desirable. Considering image quality, it is desirable for the particle diameter of the powder to be 1 m or less, preferably 0.5 μm or less. If the particle diameter is greater than 1 μm, line resolution is liable to deteriorate due to the diffusion of incident light.

The present invention is effective in a direct charging method where the charging means is brought into contact with the photosensitive member. If there is a lot of the residual toner, it adheres to the direct charging member in the following step, i.e., a charging step, so that poor charging may occur. Consequently, it is even more important to reduce the amount of the residual toner in the charging step, as compared with corona discharge, etc., where the charging means does not come into contact with the photosensitive member.

One of the preferred embodiments of the photosensitive member used for the present invention is described below: as for conductive base materials, the following may be named; metals such as aluminum or stainless steel, aluminum alloy or indium oxide-tin oxide alloy, plastics with a coating of the metals or alloys, paper or plastic impregnated with conductive particles, cylindrically formed plastic and film containing a conductive polymer, etc.

Upon these conductive base there may be provided a sub-coating for the purpose of increasing adhesion of the photosensitive layer, improving application properties, protecting the base, coating defects upon the base, charge-injectability from the base substance, protecting the photosensitive layer from electrical destruction, etc. The sub-coating is formed of materials such as, polyvinyl-alcohol, poly-N-vinyl-imidazole, polyethylene oxide, ethyl cellulose, methyl cellulose, nitro cellulose, ethylene-acrylic acid copolymers, polyvinyl butyral, phenolic resin, casein, polyamide, copolymer nylon, glue, gelatin, polyurethane, aluminum oxide, etc. The film thickness is generally 1 to 10 μm, preferably 0.1 to 3 μm.

The charge generating layer is formed by dispersing a charge generating material in an appropriate binding agent and then conducting coating or vapor deposition, in which the charge generating material is an organic material such as azo pigment, phthalocyanine pigment, indigo pigment, perylene pigment, polycyclic quinone, squarilium dye, pyrylium pigment, thiopyrylium salts and triphenyl methane pigments; or inorganic materials such as amorphous silicon. The binding agent includes polycarbonate resin, polyester resin, polyvinyl butyral resin, polystyrene resin, acrylic resin, methacrylic resin, phenolic resin, silicone resin, epoxy resin, and vinyl acetate. The amount of the binding agent contained in the charge generating layer is less than 80% by weight, preferably 0 to 40% by weight. The film thickness of the charge generating layer is 5 μm or less, preferably 0.05 to 2 μm.

The charge transporting layer has the function of receiving charge carriers from the charge generating layer in the presence of an electrical field, and transporting the carriers. The charge transporting layer is formed by dissolving a charge transporting material in a solvent along with binding resin if necessary, and then carrying out coating. The film thickness of the charge transporting layer is generally 5 to 40 μm. The charge transporting material includes polycyclic aromatic compounds having a structure such as biphenylene, anthracene, pyrene, or phenanthrene in its main or side chain; heterocyclic compounds containing nitrogen, such as indole, carbazole, oxadiazole, pyrazole; hydrazone compounds; styryl compounds; and inorganic compounds such as selenium, selenium-tellurium, amorphous silicon, cadmium sulfide.

The binding resin in which the charge transporting material is dispersed, includes resins such as polycarbonate resin, polyester resin, polymethacrylate ester, polystyrene resin, acrylic resin, and polyamide resin, and organic photoconductive polymers such as poly-N-vinyl carbazole and polyvinyl anthracene.

A protective layer may be provided as a surface layer. Resins used for this protective layer includes % polyester, polycarbonate, acrylic resin, epoxy resin, phenolic resin, or a mixture thereof with a hardening agent. These resins may be used alone or in a combination of two or more.

Conductive fine particles may be dispersed into the resin of the protective layer. The conductive fine particles may be made of metal or metal oxide. They are preferably ultra-fine particles made of material such as zinc oxide, titanium oxide, tin oxide, antimony oxide, indium oxide, bismuth oxide, titanium oxide coated with tin oxide, indium oxide coated with tin, tin oxide coated with antimony, and zirconium oxide. These may be used alone or in a combination of two or more. Generally, when dispersing particles into the protective layer, it is desirable that the particle diameter of the particles be smaller than the wavelength of the incident light, in order to prevent diffusion of the incident light due to the dispersed particles. With the present invention, it is preferable that the particle diameter of the conductive particles or insulating particles dispersed into the protective layer be 0.5 μm or less. The amount of the particles contained in the protective layer is preferably 2 to 90% by weight based on the total weight of the protective layer, more preferably 5 to 80% by weight. The thickness of the protective layer is preferably 0.1 to 10 μm, more preferably 1 to 7 μm. Coating of the surface layer can be conducted by spray coating, beam coating, or permeation coating, with the resin dispersion.

As an example of the developing unit in the present invention there is a developing unit employing a one component method in which toner is applied on the surface of an elastic roller, which is brought into contact with the photosensitive member surface. In this case, it is important that the toner upon the toner carrying member is in contact with the photosensitive member, whether magnetic toner or non-magnetic toner. However, it is preferred that the magnetic material content is smaller in order to further eliminate the influence of the minute amount of the residual toner on the shading. It is also preferred that the particle diameter of the particles of the magnetic material is smaller. The toner carrying member is actually in contact with the surface of the photosensitive member surface. This means that when the toner is removed from the toner carrying member, the toner carrying member is in contact with the photosensitive member. At this time, an image free from the edge effect can be obtained in an electric field acting through toner between the photosensitive member and the toner carrying member, while cleaning is simultaneously conducted. It is necessary that either the surface of the elastic roller or the proximity of its surface has potential and an electric field is present between the photosensitive member surface and the toner carrying member surface. This can also be attained by employing a method in which the elastic rubber of the elastic roller is resistance-controlled to a mid-resistance range so that while the continuity between the roller and the photosensitive member is inhibited an electric field is maintained, or a method in which a thin dielectric layer is provided on the surface of a conducting roller. Further, it is also possible to take such a constitution that the conductive roller is provided with a conducting resin sleeve coated with insulating material on the side opposing to the photosensitive member, or an insulating sleeve is provided with a conducting layer on the side not opposing to the photosensitive member.

In the case where the one-component developing method is used the toner carrying roller which carries the toner may rotate in the same direction as that of the photosensitive member, or in the opposite direction. When the rotational direction is the same as that of the photosensitive member, it is desirable that the peripheral speed ratio of the toner carrying roller to the photosensitive member is preferably 100% or greater. If that ratio is 100% or less, problems arise in image quality, such as deterioration of line image sharpness. The higher the peripheral speed ratio is, the more toner is supplied to the developing area, the frequency of toner adhesion to and removal from electrostatic latent images increases, and images faithful to the electrostatic latent images can be produced by the repetition that toner adhering to unnecessary areas is scraped off and toner is applied to necessary areas. A peripheral speed ratio is more preferably 110% or greater. From the view point of cleaning simultaneous with developing, since the effect of physically releasing the residual toner adhering to the photosensitive member by the difference in the peripheral speed between the photosensitive member surface and the area where the toner is adhering, and of collecting the toner in an electric field, can be expected, the higher the peripheral speed ratio of the toner carrying member to the photosensitive member is, the better the collection of the residual toner is. The present invention may also employ a member which comes into contact with the photosensitive member between transferring and charging.

The toner which is employed in the present invention has inorganic fine powder on the surface of the toner particles. This exhibits the effects on the improvement of developing efficiency, electrostatic latent image reproducibility and transfer efficiency, and decrease in fogging.

The inorganic fine powder employed in this invention includes inorganic fine powder formed of colloidal silica, titanium oxide, iron oxide, aluminum oxide, mangesium oxide, calcium titanate, barium titanate, strontium titanate, magnesium titanate, serium oxide, zirconium oxide, etc. These may by used alone or in a mixture of two or more. Titania, alumina, or silica is preferable. It is preferred that these inorganic fine powder are treated to be hydrophobic. It is particularly preferred that the inorganic fine powder has been surface-treated with silicon oil.

The toner employed in the present invention is a mixture of toner particles with at least inorganic fine powder material, to which organic fine powder or resin fine powder with an average particle diameter smaller that the average particle diameter of the toner particles may be added.

Further, the toner preferably has a specific particle size distribution. If toner particles having a particle diameter of 5 μm or smaller are in less than 17% by number, the effect of reducing consumption declines, and if the average particle diameter by volume $D_v$ (μm) is 8 μm or greater and the average particle diameter by weight $D_4$ (μm) is 9 μm or greater, resolution of 100 μm or finer dot deteriorates. If developing is forced by control of developing conditions or the like, swelling of line and toner scattering are liable to occur, and toner consumption increases. If toner particles having a particle diameter of 5 μm or smaller are in more than 90% by number, image density is lowered. 60% by number$<N_r \leqq 88\%$ by number is preferable. In order to further improve resolution, a toner having of a minute diameter of 3.0 μm$\leqq D_v \leqq$6.0 μm, 3.5 μm$\leqq D_4<$6.5 μm is preferable. Further, 3.2 μm$\leqq D_v \leqq$5.8 μm, 3.6 μm$\leqq D_4 \leqq$6.3 μm is more preferable.

In order to decrease consumption and to improve resolution of smaller isolated dots, it is preferred that the average particle diameter by volume $D_v$ (μm) is 3 μm$\leqq D_v<$6 μm, the average particle diameter by weight $D_4$ (μm) is 3.5 μm$\leqq D_4<$6.5 μm, the ratio $N_r$ of particles having a particle diameter of 5 μm or smaller in a particle size distribution by number is 60% by number $N_r \leqq 90\%$ by number, the volume ratio of particles of 8 μm or greater in a particle size distribution by volume is 15% or less by volume, and the ratio $N_m/N_v$ of the ratio $N_m$ of particles of 3.17 μm or smaller in the particle size distribution by number to the ratio $N_v$ of particles of 3.17 μm or smaller in the particle size distribution by volume is 2.0 to 8.0. It is more preferred that the ratio $N_r$ of particles having a particle diameter of 5 μm or smaller is 60% by number$\leqq N_r \leqq 88\%$ by number, and $D_v$ is 3.2 μm$\leqq D_v \leqq$5.8 μm, and $D_4$ is 3.6 μm$\leqq D_4 \leqq$6.3 μm.

When the ratio $N_m/N_v$ of the ratio $N_m$ of toner particles having a particle diameter of 3.17 μm or smaller in the particle size distribution by number to the ratio $N_v$ of toner particles having a particle diameter of 3.17 μm or smaller in the particle size volume distribution is less than 2.0, fogging is liable to occur, and when more than 8.0 resolution of around 50 μm isolated dots tends to deteriorate. 3.0 to 7.0 is more preferable. Here, the ratio $N_m$ of toner particles having a particle diameter of 3.17 μm or smaller in the particle size distribution by number is 5 to 40%, preferably 7 to 35%.

The volume ratio of toner particles having a particle diameter of 8 μm or greater in the toner particle size distribution by volume is preferably 10% or less by volume in order to decrease scattering, to control change in particle size in a developing apparatus through processing for a long time of period, and to obtain stable density.

The absolute value (mC/g) of the charge of the toner to be $14 \leqq Q \leqq 80$ (Q indicates the amount of friction charge of frictional electrification against iron powder), preferably $24 \leqq Q \leqq 60$. When $Q \leqq 14$, that amount is too small and the effect of reducing toner consumption is decreased. When $80<Q$, that amount is too large and decrease in density tends to occur.

The small particle diameter of toner attains further high image quality, increasing the amount of fine powder of 5 μm or less which is larger in the charge amount and recovering a residual toner remaining after transfer in the developing step attain a much lower consumption amounts, and employing a photosensitive member with a contact angle of 85° or more to water improves transferability of toner having a minute particle diameter. The influence of the residual toner on shading can be also reduced by making the toner particle diameter to be smaller as well as reducing the residual toner. Turbulence of electrostatic latent images due to diffusion of exposure light is decreased, and images with high image quality can be obtained.

The reason that in general the toner per unit image area used for developing is larger in line image areas than in solid image portions, may be explained as follows. With an electrostatic latent image of line image areas on the photosensitive member, unlike solid image areas, electric force lines densely curve inward from the outer side of the line latent images to the inward side of the line latent image, so that with line image areas the force attracting toner to the photosensitive member latent image surface and pressing the toner is great, and hence, more toner is liable be used for developing the line latent images.

Since the electrostatic charge latent image can be filled with small amounts of toner if the toner contains a high rate of toner particles having a particle diameter of 5 μm or less which are high in chargeability, the excess toner which has once been developed on the line image areas of the photosensitive member can return to the toner carrying member by resisting the inward curving force of the latent image electric force lines, so that only the appropriate amount of toner can remain on the line image portion. Since the toner particles having a particle diameter of 5 μm or less have greater charge per unit weight, even a small amount weakens the developing electric field so that other toner particles are not readily affected by latent image electric force lines which curve inward. In addition to this, recovery of the residual toner in the developing step enables toner consumption to be greatly reduced.

The binding resin used for toner includes polystyren; homopolymers of substituted styrene such as poly-p-chlorostyrene or polyvinyl toluene; styrene copolymers such as styrene-p-chlorostyrene copolymers, styrene-vinyltoluene copolymer, styrene-vinyl naphthalene copolymers, styrene-acrylic ester copolymers, styrene-methacrylic ester copolymers, styrene-α-methyl chloromethacrylate copolymers, styrene-acrylonitrile copolymers, styrene-vinyl methyl ether copolymers, styrene-vinyl ethyl ether copolymers, styrene-vinyl methyl ketone copolymers, styrene-butadiene copolymers, styrene-isoprene copolymers, or styrene-acrylonitrile-indene copolymers; polyvinyl chloride, phenol resin, naturally modified phenol resin, natual resin-modified maleic acid resin, acrylic resin, methacrylic resin, polyvinyl acetate, polyester resin, polyurethane, polyamide resin, furan resin, epoxy resin, exlene resin, polyvinyl butyral, terpene resin, coumarone-indene resin, petroleum resin, etc. Styrene resins such as crosslinked styrene polymers or crosslinked styrene copolymers are also preferable binding resins.

Co-monomers used with styrene monomers for the styrene copolymers include substituted or unsubstituted monocarboxylic acids having a double bond, such as acrylic acid, methyl acrylate, ethyl acrylate, butyl acrylate, dodecyl acrylate, octyl acrylate, 2-ethylhexyl acrylate, phenyl acrylate, methacrylic acid, methyl methacrylate, ethyl methacrylate, butyl methacrylate, octyl methacrylate, acrylonitrile, methacrylonitrile, or acrylamide; substituted or unsubstituted dicarboxylic acids having a double bond, such as maleic acid, butyl maleate, methyl maleate, or dimethyl maleate; vinyl ethers such as vinyl chloride, vinyl acetate, or vinyl benzoate; ethylene-type olefins such as ethylene, propylene, butylene; vinyl ketones such as vinyl methyl ketone or vinyl hexyl ketone; and vinyl ethers such as vinyl dimethyl ether, vinyl diethyl ether, or vinyl isobutyl ether. These vinyl monomers are used alone or in combination. For the crosslinking agent, compounds with two or more polymerizable double bonds is mainly used. Such compounds include aromatic divinyl compounds such as divinyl benzene or divinyl naphthalene; carboxylic acid ethers possessing two double bonds such as ethylene glycol dimethacrylate or 1,3-butanediol dimethacrylate; divinyl compounds such as divinyl ether, divinyl sulfide, or divinyl sulfone; and compounds possessing three or more vinyl radicals. These may be used alone or in combination.

Binding resins for a pressure-fixing toner includes low molecular weight polyethylene, low molecular weight polypropylene, ethylene-vinyl acetate comonomers, ethylene-ester acrylic ester copolymers, higher fatty acids, polyamide resin, and polyester resin. These may be used alone or in combination.

From the view point of improving releasability from the fixing member, and fixability, it is desirable to include in the toner the following wax: paraffin wax and derivatives thereof, micro-crystalline wax and derivatives thereof, Fischer-Tropsch wax and derivatives thereof, polyolefin wax and derivatives thereof, carnauba wax and derivatives thereof, etc. As for the derivatives, oxides, block copolymers with vinyl monomers, and graft-modified ones may be named. Further, long-chain alcohol, long-chain fatty acids, acid amide compounds, ester compounds, ketone compounds, cured castor oil and derivatives thereof, vegetable waxes, animal waxes, mineral waxes, petrolactam, etc., may also be used.

Conventionally known inorganic pigments and organic pigments may be used for the coloring agent. For example, the following may be named: carbon black, aniline black, acetylene black, naphthol yellow, hansa yellow, rhodamine lake, alizarine lake, iron oxide red, phthalocyanine blue, Indanthrene Blue, etc. These are generally used in 0.5 to 20 parts by weight based on 100 parts by weight of the binding resin.

Magnetic material may be used as a toner component. Magnetic metal oxides containing elements such as iron, cobalt, nickel, copper, magnesium, manganese, aluminum, silicon, etc., may be named as the magnetic substance. Particularly, the material containing as a main component, a magnetic iron oxide such as triiron tetroxide or γ-iron oxide is preferred. Nigrosine dye, quaternary ammonium salt, salicylic acid-metal complex salicylate, metal salicylate, salicylic derivative-metal complex, salicylic acid, acetyl acetone, etc., may be used for the purpose of controlling toner charge.

Other additives may be further added to the toner within a range in which the toner is not substantially affected. For example, the following may be named as the additives: lubricating powder such as teflon powder, zinc stearate powder, or polyvinylidene fluoride powder; polishing agents such as cerium oxide powder, silicon carbide powder, or strontium titanate powder; fluidity imparting agents such as titanium oxide powder or aluminum oxide powder, anti-caking agents; conductive property-imparting agents such as carbon black powder, zinc oxide powder, or tin oxide powder; and developability improving agents such as organic and inorganic fine particles with polarity reversed to the toner.

Further, it is preferred that the toner employed in the present invention has a material with lubricity therein, for effecting cleaning simultaneous with developing. As such a material, there are solid lubricating agents and liquid lubricating agents. The solid lubricating agents includes lubricating agent powders such as polytetrafluoroethylene powder, zinc stearate powder, polyvinylidene fluoride powder, or silicone resin fine particles; or cleavage-possessing fine powders such as molybdenum bisulfide, graphite, or boron nitride.

The liquid lubricating agents includes animal oils, vegetable oils, petroleum lubricants, synthetic lubricants, etc. Synthetic lubricants are used favorably because of stability. The synthetic lubricants include silicone oils such as dimethyl silicone oil, methyl phenyl silicone oil, or various modified silicone oils; liquid polyolester such as pentaerythritol ester or trimethylolpropane ester; liquid polyolefins such as polyethylene, polypropylene, polybutene, or poly α-olefin; liquid polyglycols such as polyethylglycol or polypropyleneglycol; liquid ester silicates such as tetradecyl silicate or tetraoctyl silicate; liquid diesters such as di-2-ethylhexyl sebacate or di-2-ethylhexyl adipate; ester phosphates such as propylphenyl phosphate; fluorinated hydrocarbon compounds such as polychlorotrifluoroethylene, polytetrafluoroethylene, polyvinylidene fluoride, or polyfluoroethylene; polyphenyl ether; alkylnaphthene; and alkyl aromatics. Of these, liquid silicon or liquid fluorinated hydrocarbons are preferable from the view point of heat stability and oxidation stability. The liquid silicones include reactive silicones which have been amino-modified, epoxy-modified, carboxyl-modified, carbinol-modified, methacryl-modified, mercapto-modified, phenol-modified, or different functional group-modified; non-reactive silicones which have been polyether-modified, methylstyryl-modified, alkyl-modified, fatty acid-modified, alkoxyl-modified, or fluoro-modified; and straight silicones such as dimethyl silicone, methyl phenyl silicone, or methyl hydrogen silicone.

The liquid lubricating agent exhibits its effects when it is carried by, or liberated from, carrier particles to be present on the surface of the toner particles. Consequently, that effect is reduced with cure-type silicone due to the nature thereof. With the reactive silicone or silicone possessing polar groups, the effect may deteriorate since its liberated amount decreases, adhesion to liquid lubricating agent carrying particles is strengthened or exhibiting of miscibility with the binding resin is exhibited. Even with non-reactive silicon, miscibility with the binding resin may occur depending on the structure of the side chain, resulting in deterioration of the effect. Consequently, liquid dimethyl silicone, liquid fluorine-modified silicone, and liquid hydrocarbon fluoride are preferably used, because reactivity and polarity are small and adhesion is not strong, and there is no miscibility with the binding resin.

It is desirable for the viscosity of the liquid lubricating agent to be 100,000 to 200,000 cSt at 25° C., preferably 200,000 to 100,000 cSt and particularly 500,000 to 70,000 cSt. The viscosity thereof is measured with a Viscotestor VT500 (manufactured by MAKEH). Any one of viscosity sensors for VT500 is selected optionally, a sample is placed in the cell for the sensor to make a measurement. The viscosity displaced on the apparatus (PaxSec) is converted into cSt.

In the present invention, the liquid lubricating agent is preferably used by carrying the lubricating agent by means of an externally added agent, or by carrying the lubricating agent by means of magnetic or non-magnetic coloring agents included the toner particles. This is superior to the addition of only the lubricating agent in dispersibility of the liquid lubricating agent into the interior and exterior of the toner particles. The amount of liquid lubricating agent upon the surface of the toner particles can be adjusted to be appropriate by means of preserving the liquid lubricating agent upon the surface of the externally added agent, and allowing the liquid lubricating agent to be present on the surface of the toner particles or in proximity thereof.

As for particular means for causing the liquid lubricating agent to be carried on the surface of the carrier particles, a wheel-type kneading machine or kneader is used. In the case where a wheel-type kneading machine is employed, the following actions are repeated: pressing action causes the liquid lubricating agent present between the carrier particles to be pressed against the surface of the carrying particles, and also presses-open the spaces between the particles so as to increase close contact between the liquid lubricating agent and the particles; shearing action spreads out the liquid lubricating agent while the shearing force relocates and breaks up the groups of particles; further, smoothing action using a spatula uniformly spreads the liquid lubricating agent existing upon the surface of the particles; and due to these three actions repeatedly conducted, lumps of the carrying agents are broken up so as to carry the liquid lubricating agent upon the surface of each of the particles. Therefore, this method is particularly preferable. Wheel-type kneading machines that may be preferably employed are: Simpson mix-mailer, Multimal, Stock-mill, Irich-mill, and reverse flow blender.

Methods are also known in which kneading machines such as Henschel mixers and ball-mixers are used to directly mix the liquid lubricating agent, as it is or diluted with a solvent, with the carrier particles and cause the carrier particles to carry the liquid lubricating agent, or to directly spray the liquid lubricating agent upon the carrier particles, thereby allowing the carrier particles to carry the liquid lubricating agent. However, caution is required with such methods if the carrying particles are of fine powder, as it may be difficult to cause the carrying particles to carry small amounts of liquid lubricating agent thereupon, or local shearing or heat may cause the liquid lubricating agent to strongly adhere, or further cause sticking, so that the liquid lubricating agent may not be liberated efficiently from the carrying particles.

As for the amount of the liquid lubricating agent with respect to the carrier particles, the amount of liquid lubricating agent with respect to the amount of binding resin is important from the viewpoint of its effect. Its optimal range is to cause the carrier particles to carry liquid the lubricating agent so that the amount of the liquid lubricating apart is 0.1 to 7 parts by weight based on 100 parts by weight of the binding resin, preferably 0.2 to 5 parts by weight, particularly 0.3 to 2 parts by weight.

Lubricating particles having the liquid lubricating agent are made by granulation or coagulation of fine particles of organic compounds or inorganic compounds as well as coloring agent with the liquid lubricating agent.

The organic compounds include resin particles such as styrene resin, acryl resin, silicon resin, polyester resin, urethane resin, polyamide resin, polyethylene resin, and fluorine resin. As for the inorganic compounds, the following can be given: oxides such as $SiO_2$, $BeO_2$, $TiO_2$, $SnO_2$, $Al_2O_3$, or $B_2O_3$ metallic oxide salts such as silicate, borate, phosphate, borosilicate, aluminosilicate, aluminoborate, aluminoborosilicate, tungstate, molybdate, or tellurate; as well as composite compounds thereof, silicon carbide, silicon nitride, amorphous carbon. These may be used either singularly or as a mixture.

Inorganic fine powder substance produced either by the dry method or wet method can be used as the inorganic fine powder substance. The method referred here to as "dry method" indicates a manufacturing method of inorganic fine powder which is generated by vapor phase of halide. This is a method which employs the thermal decomposition oxidation reaction of halide gas, for example, in oxygen/hydrogen. The basic formula thereof is as follows:

$$MX_n+1/2_nH_2+1/4O_2\rightarrow MO_2+_nHCl$$

This is a reaction formula, where, for example, M indicates a metal or metalloid, X indicates halogen element, and n indicates an integer. Specifically, if $AlCl_3$, $TiCl_4$, $GeCl_4$, $SiCl_4$, $POCl_3$, and $BBr_3$ are used, $Al_2O_3$, $TiO_2$, $GeO_2$, $SiO_2$, $P_2O_5$, and $B_2O_3$ can be respectively given. Composite compounds can be obtained if halide has been mixed in at this time.

Other manufacturing methods of obtaining fine powder using the dry method include heat CVD and plasma CVD. Particularly, $SiO_2$, $Al_2O_3$, and $TiO_2$ are used preferably.

Various conventionally known methods can be used for manufacturing inorganic fine powder substance using the wet method. An example is given below; that of decomposition of sodium silicate by acid:

$$Na_2O.XSiO_2+HCl+H_2O\rightarrow SiO_2.nH_2O+NaCl$$

There are the following methods: decomposition of sodium silicate by ammonia salts or alkali salts, the method of generating alkaline earth metal silicate from sodium silicate and then decomposing it by an acid to form silicic acid, the method of forming silicic acid from a sodium silicate solution by ion exchange resin, and the method of employing naturally occurring silicic acid or silicate. There is also another method employing hydrolysis of metal alkoxide. The general reaction formula is as shown below:

$$M(OR)_nO+1/2nH_2O\rightarrow MO_2+ROH$$

In this formula, for example, M indicates a metal or metalloid element, R indicates alkyl group, and n indicates an integer. A complex can be obtained at this time if two or more metal alkoxides are used. Of these given above, inorganic compounds are desirable, with metal oxides being particularly preferable, since they have an appropriate electric resistance. Oxides or double oxides of Si, Al, or Ti are even more preferable.

A material of which surface has been treated so as to be hydrophobic beforehand by means of coupling agent may be used as well. However, some of the liquid lubricating agents tend to become overcharged when covering the surface of the toner particles. Using such a material that has not been treated so as to be hydrophobic as carrier particles allows for appropriate leakage of charge, thereby facilitating maintaining of good developing property. Consequently, employing carrier particles which have not been treated so as to be hydrophobic is one of the most desirable forms.

It is desirable for the particle diameter of the carrier fine particles to be 0.001 to 20 μm, and particularly preferable to be 0.005 to 10 μm. It is desirable for the specific surface thereof measured by nitrogen adsorption by the BET method to be 5 to 500 $m^2/g$, more preferably 10 to 400 $m^2/g$, and further preferable to be 20 to 350 $m^2/g$. If the specific surface thereof is less than 5 $m^2/g$, it becomes difficult to maintain the liquid lubricating agent of the present invention as lubricating particles of a desirable particle diameter.

It is desirable for the amount of liquid lubricating agent upon the lubricating particles to be 20% to 90% by weight, more preferably to be 27% to 87% by weight, and particularly preferable to be 40% to 80% by weight.

It is desirable that the particle diameter of the lubricating particle be 0.5 μm or greater so as to liberate the liquid lubricating agent while maintaining it, further preferable to be 1 μm or greater, and it is also desirable that the main ingredient by standard volume distribution be greater in diameter than the particle diameter of the toner particles. The lubricating particles and heavily loaded with liquid lubricating agent, and brittle, and therefore some of the particles are collapsed during preparation of a toner and uniformly spread throughout the toner, and at the same time, liberate the liquid lubricating agent, thereby giving lubricating property and release property to the toner particles. On the other hand, the lubricating particles exist within the toner in a state of maintaining liquid lubricating agent-carrying capabilities, so the diameter thereof within the toner particles is not restricted.

The liquid lubricating agent is not excessively moved to the surface of the toner particles, and there is no deterioration of flowability or developability of the toner. On the other hand, even if part of the liquid lubricating agent is lost from the surface of the toner particles, it is possible to supplement the same from the lubricating particles, thereby maintaining the separatability or release property and lubrication of the toner particles for prolonged periods of time. These lubricating particles may be fabricated in a mixer by causing drops of the liquid lubricating agent or a solution of the liquid lubricating agent diluted in a desirable solvent to adsorb onto carrier particles. The solvent may be evaporated following pelletization, and the resulting substance further may be pulverized as necessary. A method is used where the liquid lubricating agent or a dilution thereof is added to the carrier particles and then kneaded in a kneading machine, following which pulverization may be employed for pelletization, and then subsequently the solvent is evaporated. It is preferable for the aforementioned lubricating particles to be contained at a ratio of 0.01 to 50 parts by weight as to binding resin of 100 parts by weight, more preferably to be 0.05 to 50 parts by weight, and particularly preferable to be 0.1 to 20 parts by weight. If this is less than 0.01 parts by weight, lubrication and separatability effects cannot be obtained, and if this exceeds 50 parts by weight, problems tend to occur with charge stability and productivity.

The lubricating particles can be used in a form of porous powder substance in which the liquid lubricating agent is impregnated and contained. As for the porous powder substance, there are the following: molecular sieves such as zeolite, clay minerals such as bentonite, aluminum oxide, titanium oxide, zinc oxide, and resin gel. Even with porous powder material, the particle diameter thereof is not restricted as long as the particles thereof are crushed in the kneading process during toner manufacturing, such as with resin gel. On the other hand, it is desirable for the primary diameter of porous powder substance which is difficult to crush to be 15 μm or less. It is desirable for the specific surface of the porous powder material measured by nitrogen adsorption by means of the BET method prior to impregnation of the liquid lubricating agent to be 10 to 50 $m^2/g$. The porous powder substance may be impregnated with liquid lubricating agent by treating the porous powder substance under a reduced pressure and dipping it in the liquid lubricating agent. It is desirable for the porous powder substance impregnated with the liquid lubricating agent to be 0.1 to 20 parts by weight based on 100 parts by weight of the binding resin. Also, capsule-type lubricating particles wherein the liquid lubricating agent is contained, and resin particles wherein it is dispersed, contained, expanded, or impregnated, may be used.

It is necessary to disperse the liquid lubricating agent within the toner particles in the form of lubricating particles, but as the lubricating particles and the crushed particles thereof are uniformly dispersed throughout the toner particles, the liquid lubricating agent can be uniformly dispersed to each toner particle. Conventionally, there has been usage of silicone adsorbed onto various carriers in order to disperse the silicone uniformly through the toner, which method is better in uniform dispersion than the method of simply adding silicone directly. However, the object of the present invention is not only to improve the dispersibility, but the liquid lubricating agent must be caused to be freed from the carrier particles so as to effectively exhibit the lubrication effects and separatability effects thereof, while at the same time preventing excessive liberation of the liquid lubricating agent by imparting an appropriate holding strength to the carrier particles. To this end, it is desirable to employ lubricating particles, and lubricating particles with various carrier particles carrying the liquid lubricating agent are employed.

It is possible to appropriately adjust the amount of the liquid lubricating agent on the surface of the toner particles by means of magnetic substances or other minute particles existing either in the surface of the toner particles or at close proximity thereto. The liquid lubricating agent is set free from the lubricating particles and moves to the surface of the toner particles. If the holding force of the carrier particle is strong, it becomes difficult for the liquid lubricating agent to become free, resulting in little movement thereof to the surface of the toner particles, and consequently lubrication and separatability or release property of the toner particles become difficult to obtain. If, on the other hand, the holding force is weak, the liquid lubricating agent is easily set free, resulting in excessive movement to the surface of the toner particles, and consequently charging becomes unstable, tending to cause problems with developability. The fluidity of the toner is also worsened, tending to make for problems such as irregularities in image density. Further, if all of the liquid lubricating agent is freed from the carrier particles, the effects of lubrication and separatability are lost. Since the holding force of the lubricating particles is appropriate, the liquid lubricating agent is appropriately freed from the carrier particles, the lubrication and separatability of the toner particles are maintained, as liquid lubricating agent is gradually supplied to the surface of the toner particles even if liquid lubricating agent is lost from the surface of toner particles. Since carrier particles of either magnetic substance or minute particles exist either on the surface of the toner or in close proximity thereto, liquid lubricating agent which has moved to the surface of the toner particles can be re-adsorbed, thereby preventing excessive seepage of the liquid lubricating agent. Consequently, it is important for carrier particles to exist either on the surface of the toner particles or in near proximity thereto, in order to maintain the amount of liquid lubricating agent upon the surface of the toner particles at an appropriate level. This provides for a function where excessive liquid lubricating agent is absorbed, but consumed liquid lubricating agent is quickly supplied.

From the above, the toner reaches a point of equilibrium in the effects of lubrication and separatability wherein the effects thereof are maximized, by means of a certain amount of time passing. This means that the effects thereof increase by a certain amount of time passing after manufacturing of the toner, and reach a state of equilibrium with the adsorption onto the carrier particles, thereby preventing excessive amounts of the liquid lubricating agent from coming to the surface of the toner particles. On the other hand, it is desirable to apply heat history of 30° C. to 45° C. to the toner particles since such term can be shortened and greatest effects can be obtained in a stable manner. Heat history also results in equilibrium, so a certain effect is maintained without any ill effects. The heat history may be applied at any time following manufacturing of the toner particles, and in the case of the pulverizing method, following pulverization.

It is important and desirable that magnetic substance or lubricating particles be added so that the amount of the liquid lubricating agent may be 0.1 to 7 parts by weight based on 100 parts by weight of the binding resin, more preferably 0.2 to 5 parts by weight, and particularly preferably 0.3 to 2 parts by weight.

The method of adding to the toner minute particles of metal oxide such as $SiO_2$, $Al_2O_3$, or TiO, which have been caused to adsorb organic silicon compounds such as silicone oil, is another preferable form.

Inorganic fine powder substances such as fine powder of silic acid, titanium oxide, or aluminum oxide, are preferable for the inorganic fine powder substance employed in the present invention. For example, there are the following types of fine powder of silic acid which can be used dry silica which is also called humed silica, manufactured by dry method by vapor phase oxidation of silicon halide; and the so-called wet silica which is manufactured from water-glass; but dry silica is preferable, as there are fewer silanole groups on the surface and within the silica fine powder substance, and also, there is less manufacturing residuum like $Na_2O$ or $SO_3^{2-}$. With dry silica, it is also possible to obtain composite fine powder substances of silica and other metal oxides in the manufacturing process by means of using other metal halide compounds such as aluminum chloride, and titanium chloride, along with the silicon halide compound.

It is desirable that the toner of the present invention employs inorganic fine powder substance which has been organically treated, from the point of improving environmental safety, charging safety, developability, fluidity, and preservability. This is obtained from inorganic fine powder substance which has been organically treated, agitated and mixed in a mixer such as a Henschel mixer.

As for such organic treatment methods, the following methods can be given: the processing method where reaction or physical adsorption takes place between the inorganic fine powder substance and organic metal compounds such as a silane coupling agent or titanium coupling agent; and the method where processing is conducted with an organic silicon compound such as silicone oil, either following treatment with a silane coupling agent or simultaneously with treatment with a silane coupling agent.

The following can be given for silane coupling agents to be used in the organic processing; hexamethyl disilazane, trimethyl silane, trimethyl chlorosilane, trimethyl ethoxysilane, dimethyl dichlorosilane, methyl trichlorosilane, allyl dimethyl chlorosilane, allylphenyl dichlorosilane, benzene dimethylchlorosilane, bromomethyl dimethylchlorosilane, α-chloroethyl trichlorosilane, β-chloroethyl trichlorosilane, chloromethyl dimethylchlorosilane, triorganosilyl mercaptane, trimethylsilyl mercaptane, triorganosilyl acrylate, vinyl dimethyl acetoxysilane, dimethyl diethoxysilane, dimethyl dimethoxysilane, diphenyl diethoxysilane, hexamethyl disiloxane, 1,3-divinyl tetramethyl disiloxane, 1,3-diphenyl tetramethyl disiloxane, and, dimethyl polysiloxane which has 2 to 12 siloxane units per molecule and where there is each a hydroxide group linked to one silicon atom at the unit located at the end.

Silane coupling agents containing nitrogen atoms can be given as follows: aminopropyl trimethoxysilane, aminoproryl triethoxysilane, dimethyl aminopropyl trimethoxysilane, diethyl aminopropyl trimethoxysilane, dipropyl aminopropyl trimethoxysilane, dibutyl aminopropyl trimethoxysilane, monobutyl aminopropyl trimethoxysilane, dioctyl aminopropyl dimethoxysilane, dibutyl aminopropyl dimethoxysilane, dibutyl aminopropyl monomethoxysilane, dimethyl aminophenyl triethoxysilane, trimethoxysilyl-γ-propylphenylamine, and trimethoxysilyl-γ-propylbenzylamine. A favorable silane coupling agent that can be given is hexamethyl disilazane (HMDS).

It is desirable for the surface of the inorganic fine powder to be treated either with silicone oil or with varnish. Varnish preferably used is that of viscosity of 0.5 to 10000 centistokes at 25° C., and preferably 1 to 1000 centistokes. For example, dimethyl silicone oil, methylphenyl silicone oil, α-methylstyrene modified silicone oil, chlorophenyl silicone oil, and fluoride modified silicone oil are particularly preferable. Methods used for processing the silicone oil include such as: directly mixing silicon fine powder substance treated with silane coupling agent and silicone oil together in a mixer such as a Henschel mixer; or spraying the silicone oil onto the base silica fine powder substance. Further, a method may be employed wherein silicone oil is caused to be dissolved or dispersed in an appropriate solvent, following which silica fine powder is added and mixed, with the solvent subsequently being removed.

The inorganic fine powder substance exhibits desirable results if the specific surface thereof measured by nitrogen adsorption by means of the BET method is 30 $m^2/g$ or more, and particularly within the range of 50 to 400 $m^2/g$. It is preferable for the hydrophobically-treated inorganic substance to be used at a ratio of 0.01 to 8 parts by weight based on 100 parts by weight of the toner particles, preferably 0.1 to 5 parts by weight, and particularly preferably 0.2 to 3 parts by weight.

Known methods are employed for preparing the toner. For example, the toner used in the present invention can be obtained by: thoroughly mixing binding resin, wax, metallic salt or metallic complexes, coloring agents such as pigment, dye, or metallic substance, charge controlling agent as necessary, and other additives, in a mixer such as a Henschel mixer or ball mixer; then melting and kneading the above-mentioned ingredients by means of a heat kneading machine such as a heating roller, kneader, or extruder, whereby the resins are caused to be mutually miscible, into which the metallic compounds, pigments, dyes, and magnetic substance are caused to be dissolved; subsequently conducting cooling and solidifying thereof; and then pulverization and classification is conducted in a precise manner. From the point of increased productivity, it is desirable that a multi-grading classifier be employed for the classifying process.

Further, the toner may be used as a magnetic single-component developing agent or a non-magnetic single-component developing gent, or mixed with carrier particles and used as a two-component developing agent.

With the present invention, the developing agent and the photosensitive member surface are brought into contact, and more preferably, the inverse developing method is employed. In the case that the magnetic brush developing method, which employs toner and magnetic carrier particles, is used, the magnetic particles used therein are of magnetic ferrite, magnetite, iron fillings, or these coated with resin such as acrylic resin silicone resin, or fluoride resins. Here, bias of either DC or AC component is imposed either during developing or during blank states before and following developing, so as to control the toner carrying member at a potential at which both the developing process and recovery of the residual toner upon the photosensitive member can be conducted. The DC component imposed to the toner carrying member is situated between the light area potential and dark area potential.

One of the crucial factors here is the charge polarity and the amount of charge in the various processes of electrophotography. For example, if a negatively charging photosensitive member and negatively charging toner is employed, and the toner is to be transferred to the transfer material by means of transfer potential of positive polarity, depending on the type of transfer material (differences in thickness, resistance, conductivity, etc.), the charge polarity of the residual toner changes from positive to negative. However, even if not only the photosensitive member but the residual toner also fluctuates toward positive polarity during the transfer process, both are chared to negative polarity due to the negative corona shower which occurs during charging of the negatively charging photosensitive member. Consequently, negatively charged residual toner remains upon the light area potential area where the toner should be developed, while at the dark area potential area where the toner should not be developed, the toner is pulled upward toward the toner carrying member due to the developing electric field, so that toner does not remain upon the photosensitive member which possess dark area potential.

With the reverse developing method, conditions desirable for conducting simultaneous developing-cleaning can be attained as follows: it is desirable to set the relation of the dark area potential ($V_d$) and the light area potential ($V_l$) on the photosensitive member surface, and the DC bias ($V_{DC}$) imposed to the toner carrying member, so that they satisfy the following:

$$|V_d-V_{DC}|>|V_l-V_{DC}$$

It is further preferable that the value of $|V_d-V_{DC}|$ exceeds that of $|V_1-V_{DC}|$ by 10 V or more.

Figure 8:
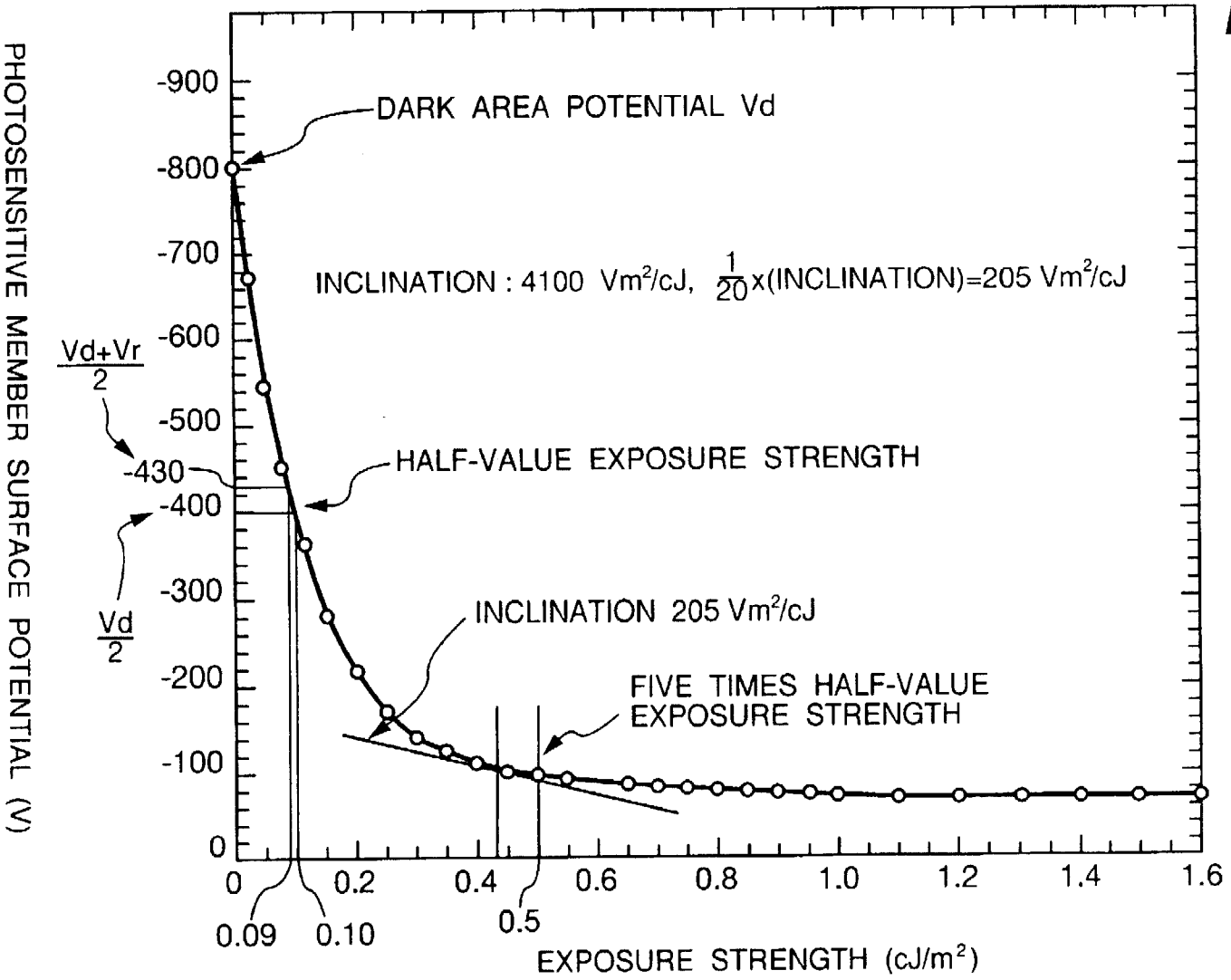
FIG. 8 is a drawing illustrating the exposure strength-surface potential curve of the photosensitive member No. 4.

The inventors of the present invention, from through scrutiny, are able to obtain a graphic image with gradation and of good reproducibility of isolated dots with the simultaneous developing-cleaning method, due to forming an electrostatic latent image at exposure strength which is less than 5 times of the half-value exposure strength and greater than the exposure strength of the point at which the following lines meet: a straight line which has an inclination of 1/20 of the inclination of the straight line connecting $V_d$ which is the photosensitive member exposure strength-surface potential properties curve and $(V_d+V_r)/2$; and the exposure strength-surface potential properties line as illustrated in FIG. 8.

The exposure method is not restricted to any particular method, but laser is favorably used, from the point of small diameter of spot, and power.

If the exposure quantity is weak, narrowing and blotching of line portions occur; and if the exposure quantity is 5 times or greater than the half-value light quantity, the results are undesirable, the resultant graphic image being such that isolated dots have collapsed and are without gradation, even though there is no occurrence of a ghost image.

Further, with the present invention, from the point of reproducability of isolated dots, dot reproducability is further improved if the half-value exposure strength of the photosensitive member is made to be 0.5 cJ/cm$^2$ or less. The reason thereof is that employing such a photosensitive member of relatively high sensitivity decreases the fluctuation of potential to exposure strength more than one with a relatively low sensitivity, regresing shading of exposure due to residual toner. Even more preferable results are obtained with a half-value exposure strength of 0.3 cJ/cm$^2$ or less.

A wider selection range of exposure is provided and also preferable effect on the device design is obtained when the coefficient of (exposure range)/(half-value exposure quantity) is increased, wherein the exposure range that is greater than the exposure strength of the point at which a straight line which has an inclination of 1/20 of the inclination of the straight line connecting $V_d$ and $(V_d+V_r)/2$ and the photosensitive member properties line meet and is less than 5 times of the half-value exposure strength, and the half-value exposure quantity is used as unit exposure quantity. It is desirable for this coefficient to be 0.7 or greater, and more preferable to be 1.0 or greater.

Further, the electrophotographic photosensitive member exposure quantity-surface potential properties curve of the present invention is based on the values measured under the process conditions of the device in which the photosensitive member is actually used. The measurement method is as follows: an electrometer probe is positioned directly behind the exposure position. First, the dark area potential of the photosensitive member potential when there is no light is recorded as $V_d$. Then, the exposure strength is gradually changed, and the photosensitive member surface potential during that time is recorded. The half-value exposure strength refers to the exposure strength at which the photosensitive member surface potential becomes half of $V_d$, i.e., $V_d/2$. Also the photosensitive member surface potential when exposure has been conducted at 30 times of the half-value exposure strength is defined as being residual potential $V_r$.

The following is a detailed description with reference to FIG. 8 which indicates the exposure strength-surface potential property curve of the later-mentioned photosensitive member No. 4. The photosensitive properties of the photosensitive member No. 4 were measured using a laser beam printer (LBP-860: manufactured by Canon Inc.) for an electrophotographic apparatus. The processing speed was 47 mm/sec. The electrostatic latent image formation was made to be 300 dpi and binary. The charging member of the photosensitive member has been changed from a charging roller to a corona charger.

Measurement of the photosensitive member properties were conducted by means of changing the light quantity of the laser beam (approximately 780 mm), and monitoring the potential thereof. Here, the laser exposure covers the entire surface due to continuous irradiation in the direction of sub-scanning.

The changed surface potential of photosensitive member No. 4 is measured, and further, the surface potential thereof under various exposure strengths is measured, thereby creating an exposure strength-surface potential properties curve.

As shown in FIG. 8, the dark area potential ($V_d$) of photosensitive member No. 4 is −800V, and the residual potential ($V_r$) thereof is −60V. Therefore, since $(V_d+V_r)/2$ is −430V, and the exposure strength is 0.09 cJ/m$^2$. The inclination of the straight line connecting the two points, namely, the potential −800V and the potential −430V, is approximately 4100 Vm$^2$/cJ. Therefore, the value of 1/20 of the inclination 4100 Vm$^2$/cJ is 205 Vm$^2$/cJ. The point where the straight line of inclination 205 Vm$^2$/cJ and the exposure strength-surface potential properties curve meet is 0.43 $cJ/m^2$. On the other hand, 1/2 of the dark area potential (Vd) of the photosensitive member No. 4 is −400V, and since the exposure strength thereat (i.e., the half-value exposure strength) is 0.10 $cJ/m^2$, 5 times the half-value exposure strength is 0.50 $cJ/m^2$. Consequently, it is desirable that the photosensitive member No. 4 have light area potential ($V_1$) of around −100V at exposure strength of 0.43 to 0.50 $cJ/m^2$.

The following describes the measurement method of the diameter of toner particles and the measurement method for friction charge.

There are various methods to measure the average particle diameter and the particle size distribution of the toner, such as using the Coulter Counter TA-II or the Coulter Multisizer (manufactured by Coulter), but a Coulter Multisizer (manufactured by COULTER) was employed in the Examples and Comparative Examples. An interface (manufactured by HITACHI) for outputting number distribution and volume distributing and a PC9801 personal computer (manufactured by NEC) were connected, and a 1% NaCl aqueous solution is prepared using first grade sodium chloride for the electrolyte solution. For example, ISOTON R-II (manufactured by Coulter Scientific Japan) may be used. The measurement is conducted as follows: 0.1 to 5 ml of a detergent (preferably alkylbenzene sulfonate) is added as a dispersing agent to 100 to 150 ml of the electrolytic solution, and then 2 to 20 mg of the measurement sample is further added. The electrolytic solution into which the sample has been dispersed is subjected to dispersion processing for 1 to 3 minutes by means of an ultrasonic dispersing machine, and then the volume and count of toner particles of 2 μm or more in diameter are measured, using the aforementioned Coulter Multisizer with a 100 μm aperture for the aperture thereof, then the volume distribution and count distribution of the toner particles are calculated. Based on that data, calculate the particle diameter average by volume ($D_v$: make the median of each channel to be the representative value of the channel) of the volume standard calculated from the volume distribution, and the average particle diameter by weight ($D_4$), and then calculate the average particle diameter by count or average particle length ($D_l$) calculated from the count distribution, the particle percentage by volume calculated from the volume distribution (8.00 μm or greater and 3.17 μm or smaller), and the particle percentage by count calculated from the count distribution (5 μm or greater and 3.17 μm or smaller).

Figure 9:
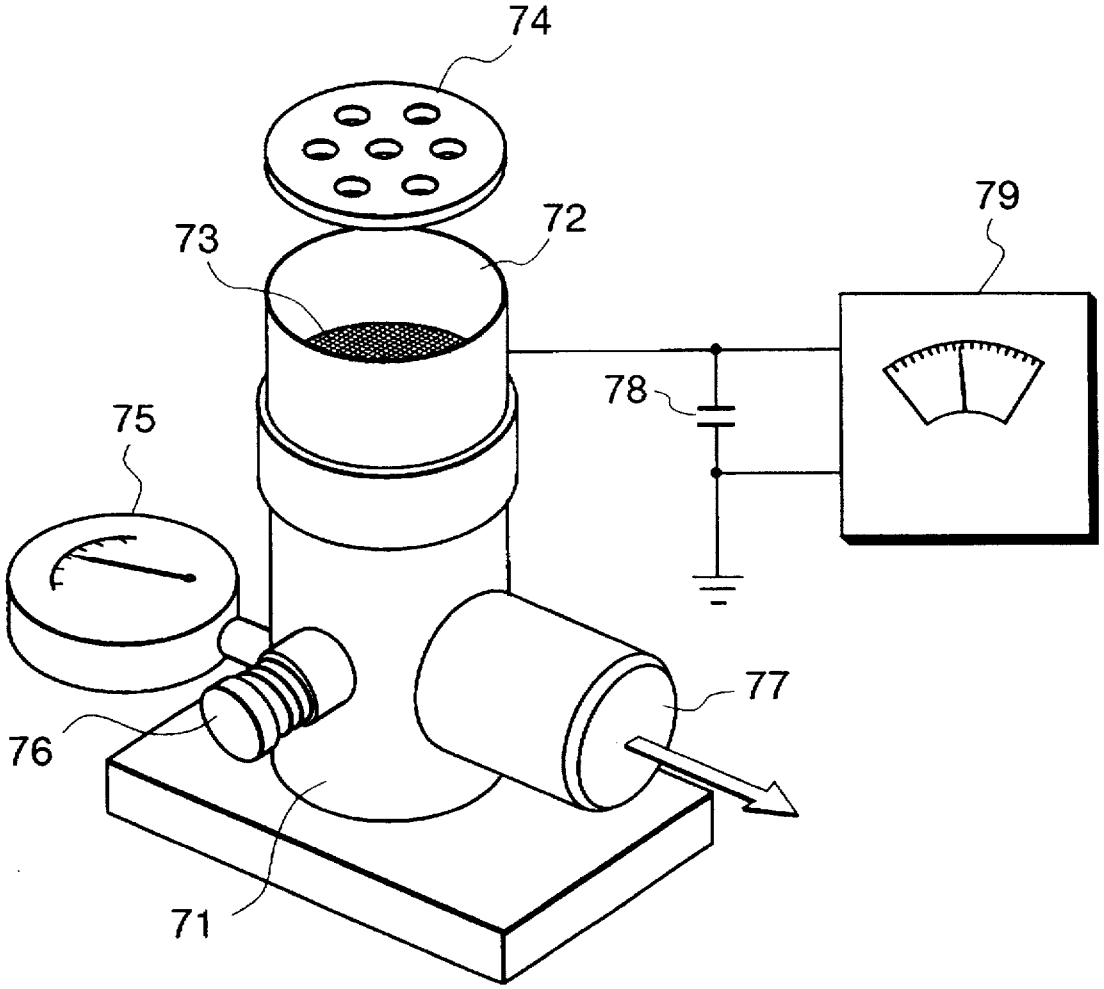
FIG. 9 is an explanatory drawing of an apparatus for measuring the amount of frictional electrification of toner.

A description of the method of measurement of the tribolectric value of the toner against iron powder carrier will be given in accordance to FIG. 9. Under an environment of 23° C. and 60% relative humidity, and using EFV 200/300 (manufactured by POWDERTEC) for the iron powder carrier, place a mixture of 1.0 g of toner and 9.0 g of the carrier into a polyethylene bottle of 50 to 100 ml in capacity and shake 50 times by hand. Next, place 1.0 g to 1.2 g of the aforementioned mixture into the metal measuring container 72 which is provided with a screen 73 of #500 mesh at the bottom thereof, and close the metal lid 74. At this point, measure the entire weight of the measuring container 72; this is to be $W_1$ (g). Next, using the aspirator 71 (the portion connected with the measuring container 72 is at least an insulating member), conduct vacuuming from the vacuuming vent 77 and adjust the air volume adjusting valve 76 so that the pressure of the vacuum gauge 75 is 2450 hPa (250 mmAg). Continue vacuuming for one minute in this state, thereby remove the toner. The potential of the electrometer 79 at this time is to be V (volts). Here, 78 is a condenser, and the capacity thereof is to be C (μF). Further, the mass of the entire measuring container following vacuuming is to be $W_2$ (g). The friction charge (mC/g) of this toner is calculated as shown in the following expression:

$$(mC/g)=CV/(W_1-W_2)$$

PREFERRED EMBODIMENTS

The following is to illustrate the present invention with reference to embodiments. However, the present invention is not limited to these.

MANUFACTURING EXAMPLE 1 OF PHOTOSENSITIVE MEMBER

An aluminum cylinder of 30 mm in diameter and 254 mm in length was used as the base of the photosensitive member. Photosensitive member No. 1 was prepared by successive immersion coating on the base so as to form layers of the structure as shown in FIG. 1.

(1) Conductive coating: The main ingredients used were tin oxide and titanium oxide powders dispersed in a phenol resin. The thickness thereof was 15 μm.

(2) Subbing layer: The main ingredients used were modified nylon and copolymer nylon. The thickness thereof was 0.6 μm.

(3) Charge generation layer: The main ingredient used was an azo pigment exhibiting absorption in the long wavelength range dispersed in a butyral resin. The thickness thereof was 0.6 μm.

(4) Charge transport layer: The main ingredient used was a hole-transporting triphenylamine compound dissolved in polycarbonate resin (molecular weight 20,000 by Ostwald's viscosity method) in the weight ratio 8:10, to which polytetrafluoroethylene powder (average particle diameter, 0.2 μm) was added at 10% by weight to all solids, and uniformly dispersed and used. The thickness thereof was 25 μm. The contact angle of the photosensitive member surface with water was 95°.

The angle of contact was measured using pure water and a contact angle meter model CA-DS, manufactured by Kyowa Kaimen Kagaku K.K.

MANUFACTURING EXAMPLE 2 OF PHOTOSENSITIVE MEMBER

(COMPARATIVE EXAMPLE)

A photosensitive member No. 2 was prepared in the same manner as in Manufacturing Example 1 except that polytetrafluoroethylene powder was not added. The contact angle of the photosensitive member surface with water was 74°.

MANUFACTURING EXAMPLE 3 OF PHOTOSENSITIVE MEMBER

A photosensitive member No. 3 was prepared according to Manufacturing Example 1 to the step of the charge transport layer preparation. For the charge transport layer, a hole-transporting triphenylamine compound dissolved in polycarbonate resin in the weight ratio 10:10 was applied to a thickness of 20 μm. Further, on top thereof, as a protective coating, the same ingredients but in the weight ratio 5:10 were dissolved, into which polytetrafluoroethylene powder (average particle diameter of 0.2 μm) was added at 30% by weight of all solids and uniformly dispersed, was applied by spray-coating onto the charge transporting layer. The thickness was adjusted to 5 μm. The contact angle of the photosensitive member surface with water was 102°. The exposure strength-surface potential characteristic curves of the above-mentioned photosensitive members Nos. 1–3 were determined using a laser beam printer (LBP-8 Mark IV).

MANUFACTURING EXAMPLE 4 OF PHOTOSENSITIVE MEMBER

An aluminum cylinder of 30 mm in diameter and 254 mm in length was used as the base of the photosensitive member. A photosensitive member was prepared by successive immersion coating thereto so as to form layers of the structure as illustrated in FIG. 1.

(1) Conductive coating: The main ingredients used were tin oxide and titanium oxide powders dispersed in phenol resin. The thickness thereof was 15 μm.

(2) Subbing layer: The main ingredient used were a modified nylon and a copolymer nylon. The thickness thereof was 0.6 μm.

(3) Charge generation layer: The main ingredient used was titanyl phthalocyanine pigment which shows absorption in the long wavelength range, dispersed in a butyral resin. The thickness thereof was 0.6 μm.

(4) Charge transport layer: The main ingredient used was a hole-transporting triphenylamine compound dissolved in a polycarbonate resin in the weight ratio 9:10, into which polytetrafluoroethylene powder (average particle diameter, 0.2 μm) was added at 10% by weight of all solids, and uniformly dispersed and used. The thickness thereof was 25 μm. The initial contact angle of photosensitive member No. 4 with water was 95°.

MANUFACTURING EXAMPLE 5 OF PHOTOSENSITIVE MEMBER

The photosensitive member was prepared according to Manufacturing Example 1 up to the preparation step of the charge transporting layer. A hole-transporting triphenylamine compound dissolved in a polycarbonate resin in the weight ratio 10:10 was used for the charge transporting layer. The thickness thereof was 20 μm. Further, on top thereof, as a protective coating, the same ingredients but in the weight ratio 5:10 was dissolved, into which polytetrafluoroethylene powder (average particle diameter of 0.1 μm) was added at 30% by weight of all solids and uniformly dispersed, was applied by spray-coating. The thickness thereof was 5 μm. The angle of contact of photosensitive member No. 5 with water was 102°. The potential characteristics and the angles of contact with water of the photosensitive members Nos. 1–5 are shown in Table 1.

TONER MANUFACTURING EXAMPLE A

Styrene-acrylic resin (weight average molecular weight 200,000):

100 parts by weight

Iron complex of azo pigment (negative charge controlling agent):

2 parts by weight

Carbon black (coloring agent):

6 parts by weight

Low molecular weight propylene-ethylene copolymer (releasing agent):

4 parts by weight

After the above materials were dry-mixed, the mixture was kneaded by a twin-screw extruder set at 130° C. The kneaded material was cooled and then pulverized by an air jet pulverizer, classified by a multi-division classifier, so that toner particles with a weight average particle diameter of 5.2 μm and desired particle distribution were obtained. Thus obtained toner particles were mixed in an amount of 98.5 wt % with 1.5 wt % of hydrophobic silica fine powder (BET 200 $m^2/g$) of which surface had been treated with silicone oil, thereby formulating Toner A.

TONER MANUFACTURING EXAMPLE B

Toner particles were manufactured in the same manner as Toner A except for the particle size distribution thereof, were mixed in an amount of 99% by weight with 1.0% by weight of hydrophobic silica fine powder (BET 250 $m^2/g$), thereby formulating Toner B with weight average particle diameter of 5.2 μm.

TONER MANUFACTURING EXAMPLES C–F

Styrene-acrylic resin:

100 parts by weight

Metallic salt complex of azo pigment:

2 parts by weight

Carbon black:

6 parts by weight

Low molecular weight propylene-ethylene copolymer:

4 parts by weight

After the above materials were dry-mixed, the mixture was kneaded by a twin screw extruder set at 130° C. The obtained kneaded material was cooled, then pulverized by an air jet pulverizer, and air-classified, so that toner particles C–F with weight average diameters of 4.0 μm, 5.0 μm, 6.8 μm, and 9.8 μm having desired particle distributions were obtained respectively. The obtained toner particles were each mixed with 1.5% by weight of hydrophobic silica fine particles (BET 200 $m^2/g$) of which surface thereof had been treated with silicone oil, thereby formulating Toners C, D, E, and F.

TONER MANUFACTURING EXAMPLE G

Toner particles prepared in Manufacturing Example A were mixed in an amount of 98.8% by weight with 1.0% by weight of hydrophobic silica fine particles (BET 200 $m^2/g$) of which surface thereof had been treated with silicone oil, and with 0.2% by weight of hydrophobic titania fine particles (BET 100 $m^2/g$), thereby formulating Toner G with a weight average particle diameter of 5.2 μm.

TONER MANUFACTURING EXAMPLE H

Toner particles prepared in Manufacturing Example A were mixed in an amount of 98.8% by weight with 1.0% by weight of hydrophobic silica fine particles (BET 200 $m^2/g$) of which surface thereof had been treated with silicone oil, and with 0.2% by weight of hydrophobic alumina fine particles (BET 100 $m^2/g$), thereby formulating Toner H with a weight average particle diameter of 5.2 μm.

TONER MANUFACTURING EXAMPLE I

Polyester resin (weight average molecular weight 100,000):

100 parts by weight

Magnetite (magnetic substance and coloring agent, average particle diameter of 0.2 μm):

30 parts by weight

Metal complex of azo pigment (negative charge controlling agent):

2 parts by weight

Carbon black (coloring agent):

6 parts by weight

Low molecular weight propylene-ethylene copolymer releasing agent):

4 parts by weight

After the above materials were dry-mixed, the mixture was kneaded by a twin-screw extruder set at 130° C. The obtained kneaded material was cooled, then pulverized using an air jet pulverizer, and air-classified so that toner particles with a weight average diameter of 5.5 μm having a desired particle distribution were obtained. The obtained toner particles were mixed in an amount of 98.5% by weight with 1.5% by weight of hydrophobic silica fine particles (BET 200 $m^2/g$), thereby formulating Toner I.

The properties of the above toners A through I are shown in Table 2.

MANUFACTURING EXAMPLE OF TWO-COMPONENT DEVELOPING AGENT

A two-component developer J was prepared by mixing 5 parts by weight of a toner having a weight average particle diameter of 5.2 μm with 100 parts by weight of magnetic ferrite carrier (weight average particle diameter, 50 μm), where the toner is a mixture of 98% by weight of toner particles prepared in the Manufacturing Example A and 2.0% by weight of hydrophobic colloidal silica fine particles (BET 200 $m^2/g$).

Figure 2:
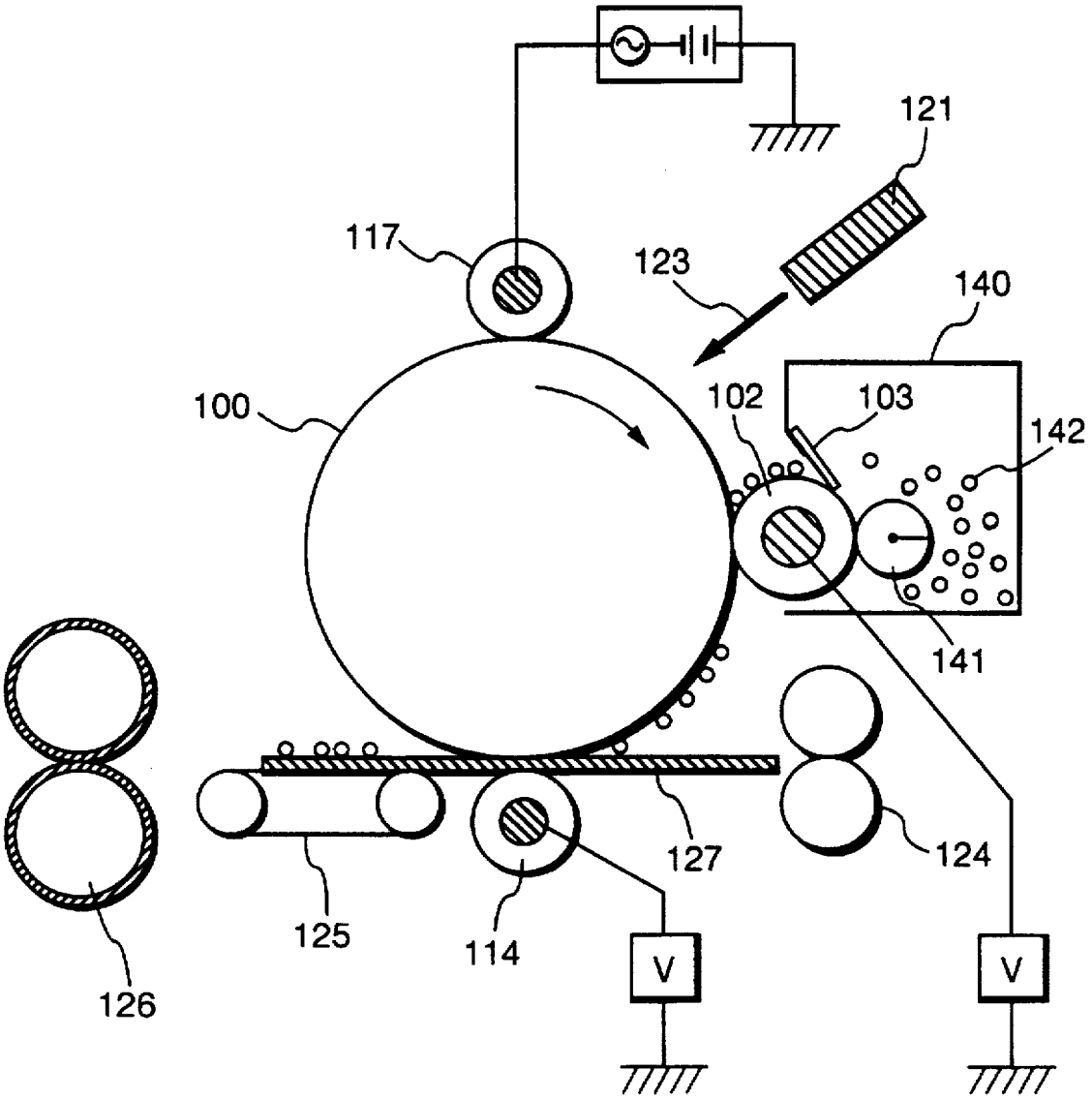
FIGS. 2 through 6 are explanatory drawings illustrating an electrophotography process.

The following is an explanation of one system example of for implementing the image formation method according to the present invention, with reference to FIG. 2. In FIG. 2, 100 is a photosensitive drum of which angle of contact with water is 85° or greater, around which are provided a primary charging roller 117, a developer assembly 140, a transfer charging roller 114, and a register roller 124. The photosensitive drum 100 is charged by means of the primary charging roller 117 to, for example, −700 V. The applied voltage at this point is −2.0 $kV_{pp}$ in AC and −700 $V_{dc}$ in DC. A laser beam 123 generated by the laser generating device 121 is irradiated to the photosensitive drum 100 to exposure and form an electrostatic latent image. The electrostatic latent image upon the photosensitive drum is developed with toner 142 by means of the developing assembly 140, and is transferred onto transfer material 127 by means of the transfer roller 114 which is brought into contact with the photosensitive drum via the transfer material 127. The transfer material upon which the transfer image is transferred is transported by means of the transporting belt 125 to the fixing assembly 126, where the transferred image is fixed to the transfer material. At the developing assembly 140, a toner carrying member 102, which is an elastic roller having a metal mandrel, is situated so as to press against the photosensitive drum 100. A toner restricting blade 103 is provided as a member to restrict the amount of the toner transported attaching to the toner carrying member 102, that is, the toner restricting blade 103 controls the amount of the toner transported to the developing zone, by means of contact pressure against the toner carrying member 102. An stirring rod 141 is provided within the developing assembly 140. At the developing zone, a developing bias either of AC or DC is imposed between the photosensitive drum 100 and the toner carrying member 102, whereby the toner upon the toner carrying member 102 migrates onto the photosensitive drum 100 according to the electrostatic latent image, thereby forming a toner image.

EXAMPLE 1

A 600 dpi laser beam printer (LBP-8 Mark IV: Manufactured by CANON) was used as an electrophotographic apparatus. The printer was modified so that the processing speed thereof was 24 mm/sec (the peripheral speed of the toner carrying member is variable), printing 4 sheets of LTR size paper per minute. Further, the cleaning rubber blade provided to the processing cartridge of the LBP-8 Mark IV was removed, and the charging assembly for charging the photosensitive member was replaced with a corona charging unit 21.

Figure 5:
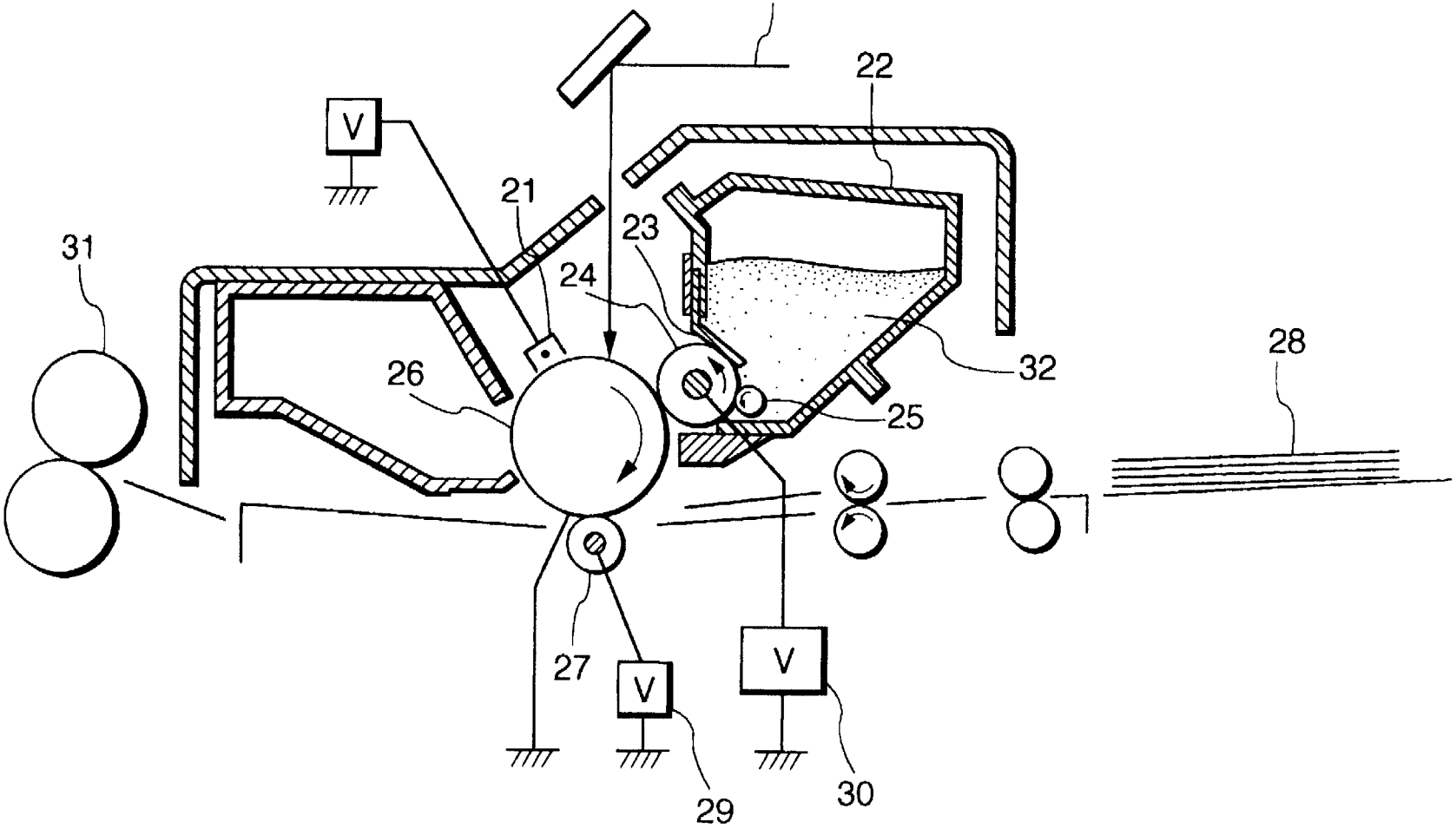

The overview of the apparatus will further be described in accordance with FIG. 5. In the apparatus, the photosensitive member 26 (30 mm in diameter) is uniformly charged by means of the corona charging assembly 21. Following charging, an electrostatic latent image is formed by image-wise exposure with laser beam 20, a toner image is formed based on the electrostatic latent image with toner 32 by reverse developing method, then the toner image is transferred to the transfer material 28 by means of the transfer roller 27 to which a voltage has been applied from a bias imposing means 29.

Next, the developer container 22 in the processing cartridge was modified. Instead of an aluminum sleeve enveloping a magnet, a rubber roller of medium resistivity (16 mm in diameter, the metal core thereof being 6 mm in diameter, formed from foamed silicone rubber with an electric resistance value of $5 \times 10^5$ Ω.cm) is used as the toner carrying member 24, and brought into contact with the photosensitive member 26. The toner carrying member is driven at a peripheral speed of 200% of the peripheral speed of the photosensitive member, with the same rotational direction at the point of contact. The peripheral speed of the toner carrying member is 48 mm/s, and the peripheral speed of the photosensitive member is 24 mm/s.

An applying roller 25 was provided in contact with the toner carrying member 24 as a means to apply the toner to it. By rotating the applying roller in a direction opposite to that of the toner carrying member, the toner was applied to the surface of the toner carrying member 24. Further, a stainless steel blade 23 coated with resin was attached as a means of controlling the toner layer upon the toner carrying member 24. A predetermined voltage was applied to the metal core of the toner carrying member 24 by means of bias imposing means 30.

Using photosensitive member No. 1 as the photosensitive member and using Toner A as the toner, process conditions were set to satisfy the following developing conditions.

Dark area potential of photosensitive member (Vd) −800 V

Light area potential of photosensitive member (Vl) −100 V

Developing bias (VDC) −400 V (DC component only)

The toner image upon the transfer material was fixed by means of heat and pressure means 31.

Evaluation of the image was conducted using an output pattern which forms 5×5 mm solid black squares arranged with 5 mm spacings in the white area starting from the top end of a A4 sized transfer medium, corresponding to one rotation of the photosensitive member, and then fills the remaining area with half tone image comprised of one dot lines and two dots spaces.

For the transfer material 28, plain paper of 75 $g/m^2$, a double weight paper of 130 $g/m^2$, and overhead projector film were used The evaluation was carried out by taking the difference of the reflection density between the areas of the second rotation of the photosensitive member corresponding to the image area (printed portion) and the area where no print image was formed (non-printed area) during the first rotation of the photosensitive member, using a Macbeth reflection density meter. The reflection density difference is calculated by subtracting the reflection density of the area corresponding to the non-image area from the reflection density of the area corresponding to the image area. The smaller the reflection difference, the better the ghost level is. Ghost evaluation was conducted at the initial stage and after the running testing on 500 sheets and good results were obtained. Other image evaluation tests were conducted as well, the results were good in fogging, dot scattering, and resolution, thus the image quality was as good as the initial quality.

The evaluation of dot-scattering in the present invention is carried out on the dot-scattering around the fine curving lines which affects the quality of graphical images, that is, scattering around 1-dot lines where scattering occurs more readily than with type lines.

Figure 11:
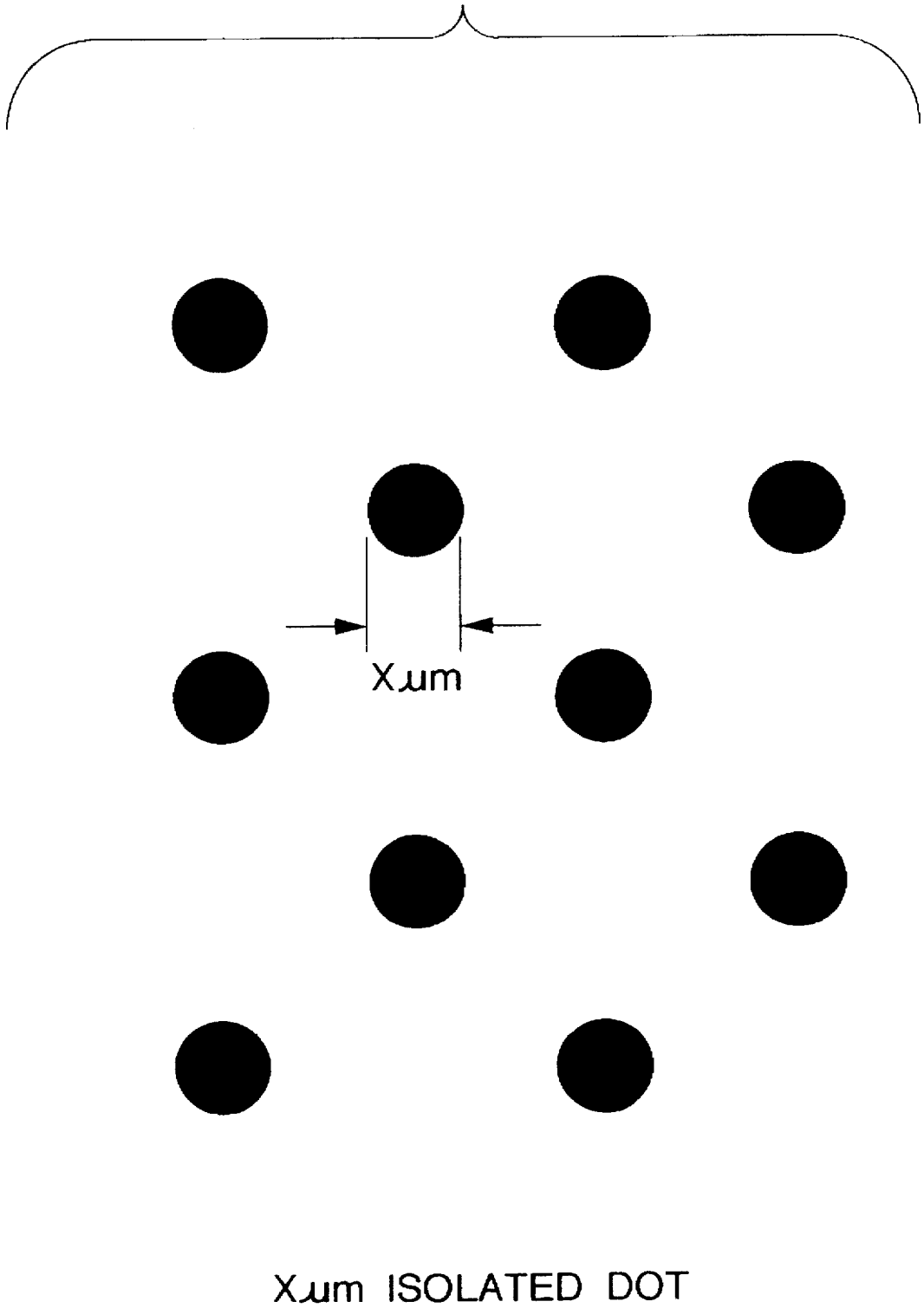

Resolution was evaluated for reproducibility of small isolated dot pattern as illustrated in FIG. 11, where the electrical field closes easily making reproduction difficult. Fogging was evaluated using a reflectometer (REFLECTOMETER ODEL TC-6DS, manufactured by TOKYO DENSHOKU CO., LTD.). The amount of fogging was calculated by subtracting Dr, i.e., the average value of reflected density of the paper before printing, from Ds, i.e., the worst reflected density value of the white area of the paper after printing. Fogging of 2% or less is a good image with no actual fogging, and 5% or more is an unclear image with apparent fogging.

A letter pattern with 4% printed area in A4 sheet was printed on 500 sheets consecutively, then the consumed toner amount was calculated from the change of the toner amount in the developing assembly. It was 0.025 g of toner per sheet. Further, a latent image of 600 dpi 10-dot vertical line pattern (line width 420 μm, at 1 cm intervals) was made on the photosensitive member by means of laser beam exposure, which was developed with the toner and then transferred to polyethylene telephthalate (PET) OHP film, and fixed. A surface coarseness meter, Surfcorder SE-30H (manufactured by Kosaka Kenkyusho) was used to evaluate the condition of the toner on the vertical lines of the obtained image as a surface coarseness profile, and the line width was determined from this profile width. As a result, it was confirmed that the line width was 430 μm, the line having been reproduced at a high density and clearly, and that low toner consumption was attained while maintaining latent image reproducibility. The evaluation results are shown in Table 4.

EXAMPLE 2

Image formation and evaluation was conducted in the same manner as in Example 1, except for the following:

The toner carrying member 24 was rotated with peripheral speed of 250% of the peripheral speed of the photosensitive member 26, in the same direction at the point of contact. The peripheral speed of the toner carrying member 24 was 60 mm/sec, and the peripheral speed of the photosensitive member 26 was 34 mm/sec.

Using Photosensitive member No. 3 as the photosensitive member 26 and using Toner B as the toner 32, process conditions were set to satisfy the following developing conditions:

| | |
|---|---|
| Developing bias | −300 V (DC component only). |

Figure 3:
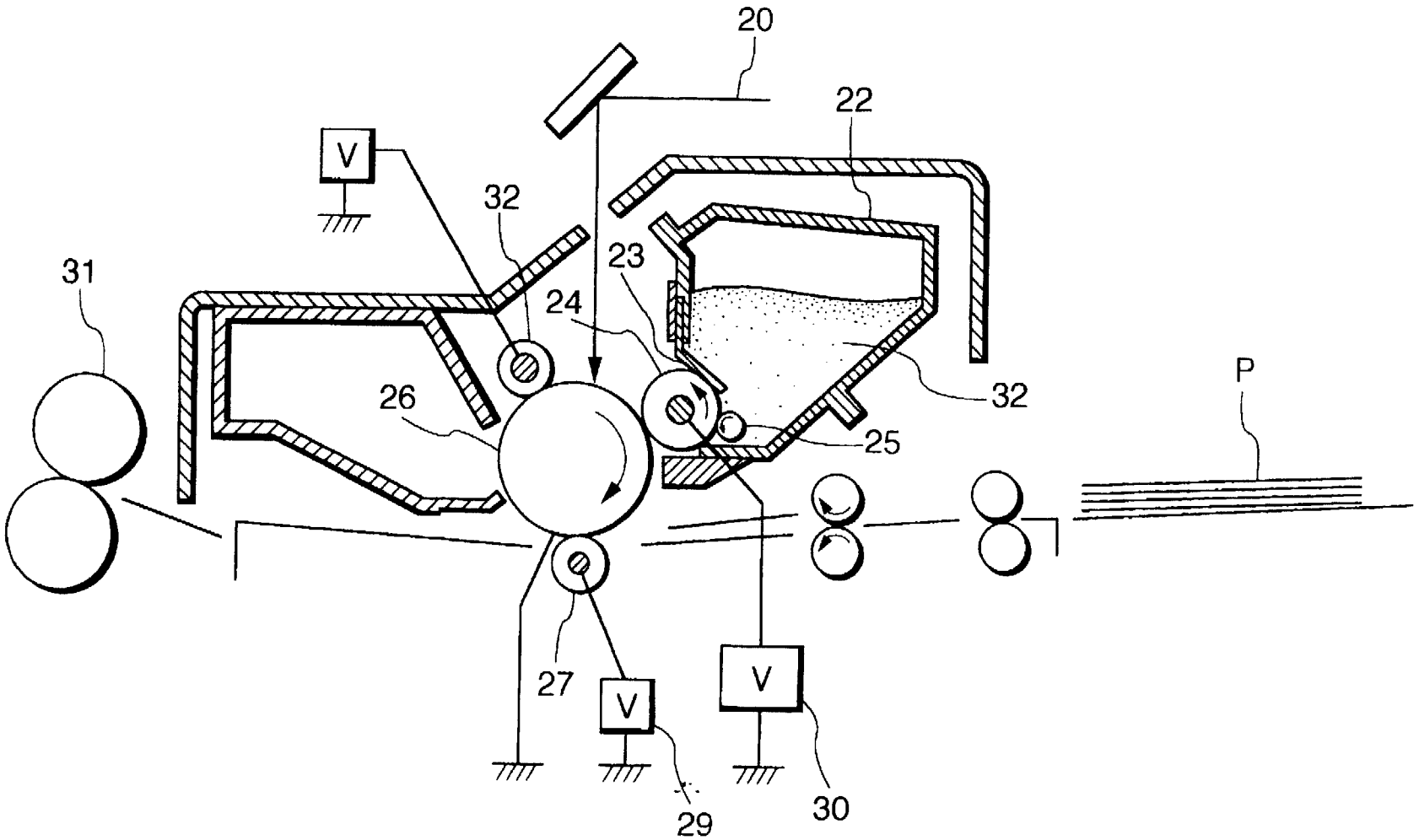

As shown in FIG. 3, a contact roller charging unit 32 was used as the charging assembly (imposing 1400 V of DC only), and the photosensitive member 26 was uniformly charged. Following charging, an electrostatic latent image was formed by image-wise exposure with laser beam 20, which is made into a visual image with toner 32, followed by the toner image being transferred to the transfer material 28 by means of the transfer roller 27 to which voltage was imposed.

Image formation test was conducted on 500 sheets and good results were obtained in ghost phenomenon, image density, fogging, scattering, resolution, and toner consumption amount, thus the same good image quality was maintained as the initial image quality. The evaluation results are shown in Table 4.

EXAMPLE 3

Image formation and evaluation was conducted in the same manner as in Example 1, except for the following:

The toner carrying member 24 was rotated with peripheral speed of 150% of the peripheral speed of the photosensitive member 26, in the same rotational direction at the point of contact. Using Photosensitive member No. 3 and Toner I, process conditions was set to satisfy the following developing conditions.

| | |
|---|---|
| Developing bias | −350 V (DC component only) |

Image formation test was conducted on 500 sheets and good results were obtained in ghost phenomenon, image density, fogging, scattering, resolution, and toner consumption amount, thus the same good image quality was maintained as the initial image quality. The evaluation results are shown in Table 4.

EXAMPLES 4–6

Image formation and evaluation was conducted in the same manner as in Example 1, except that Toners C, D, and E were employed. When Toner E was used, reproduction of electrostatic latent line images of about 50 μm width was slightly poor, and the toner consumption amount was slightly higher, but good image quality was obtained as in Example 1. The evaluation results are shown in Table 4.

EXAMPLES 7 and 8

Image formation and evaluation was conducted in the same manner as in Example 1, except that Toners G and H were employed. Image density was slightly light, but practically good images were obtained. The evaluation results are shown in Table 4.

EXAMPLE 9

Figure 6:
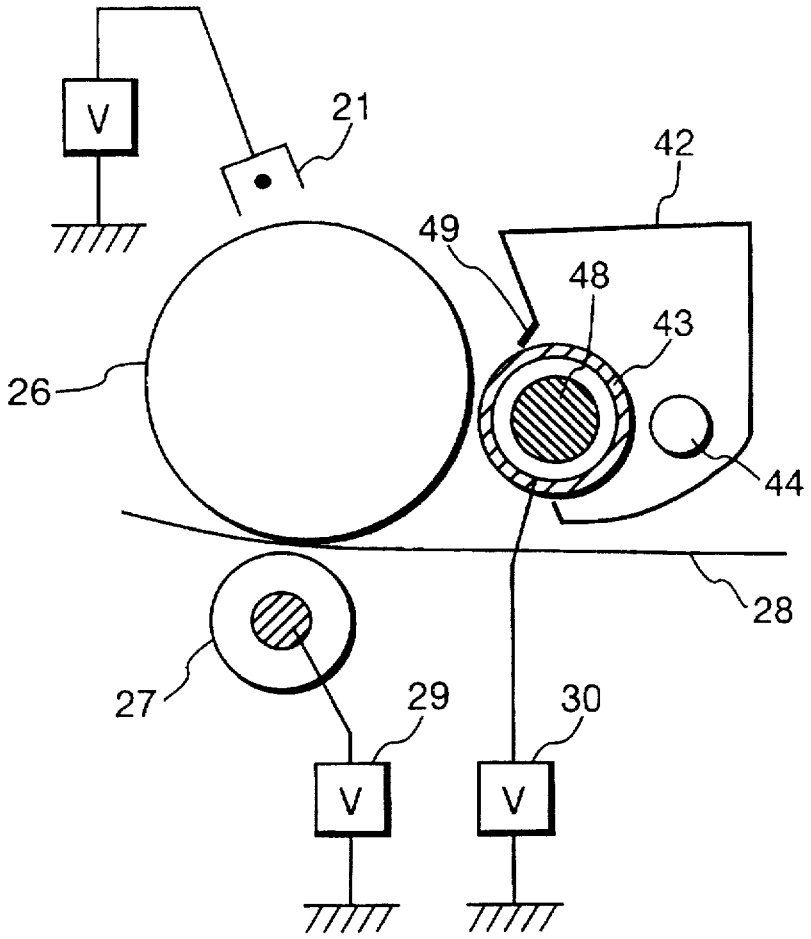
Figure 7:
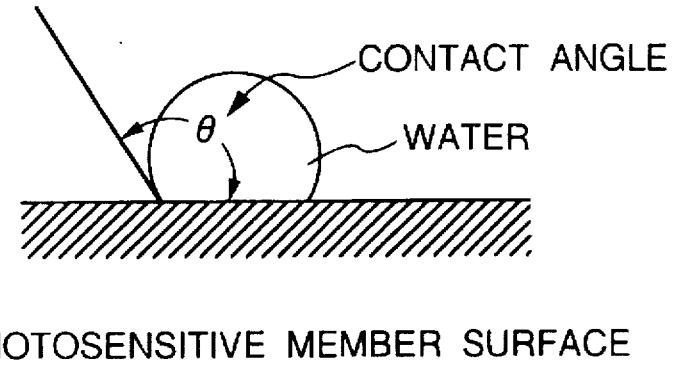
FIG. 7 is an explanatory drawing concerning a contact angle of a photosensitive member surface with respect to water.

As an electrophotographic apparatus, a 600 dpi laser beam printer (LBP-8 Mark IV: Manufactured by CANON) was modified to have a corona charger. A schematic drawing is shown in FIG. 6. Further, the closest gap distance (S–D) between the toner carrying member 43 which possesses a magnet 48 within and the photosensitive member was made to be 500 μm, the voltage imposed by means of the bias imposing means 30 at the time of developing was made by superimposing AC component (2000 Vpp, 200 Hz) to DC component (−350 V), and the charge potential of the photosensitive member 26 was made to be −800 V for dark area potential (Vd) and −100 V for light area potential (Vl).

Two-component developer J was used as the developing agent, and Photosensitive member No. 3 of Manufacturing Example 3 was used as the photosensitive member.

Next, the developing container 42 in the processing cartridge was modified. The LBP-8 Mark IV process cartridge enveloping a magnet 48 was used as the toner carrying member without modification. The toner carrying member 43 was rotated with a peripheral speed of 150% of the peripheral speed of the photosensitive member, in the same rotational direction at the contact point of the photosensitive member 26 and the layer of the two-component developer. The peripheral speed of the toner carrying member was 72 mm/s, and the peripheral speed of the photosensitive member was 48 mm/s.

As a means of restricting brush formation of the magnetic toner upon the toner carrying member, the contact elastic rubber blade was replaced with a magnetic blade 49, which was placed facing the cut magnet of the magnet 48 which is enveloped in the toner carrying member 43 (developing sleeve) and at a gap distance of 300 μm. In the modified apparatus, the photosensitive member is uniformly charged by a corona charger 21, an electrostatic latent image was formed by image-wise exposure with laser beam, which is then developed into a toner image by reverse developing with two-component developer, then the toner image is transferred to the transfer material 28 by means of the transfer roller 46 to which a voltage was imposed, and subsequently fixed to the transfer material by application of heat and pressure. The processing speed thereof was 24 mm/sec (the peripheral speed of the toner carrying member is variable), and 4 sheets of LTR sized paper per minute were printed. The results are shown in Table 4.

COMPARATIVE EXAMPLE 1

Image formation and evaluation was conducted in the same manner as in Example 1, except that Photosensitive member No. 2 (angle of contact with water: 74°) was employed. Process conditions were set to satisfy the following developing condition.

| | |
|---|---|
| Developing bias | −400 V (DC component only) |

Image formation test was conducted on 500 sheets, but there was a considerable amount of residual toner after transfer. There occurred ghost image because of the residual toner interfering the exposure of Photosensitive member No. 2, and fogging due to insufficient recovery of the toner. The evaluation results are shown in Table 4.

COMPARATIVE EXAMPLE 2

Image formation and evaluation was conducted in the same manner as in Example 1, except that Toner F and Photosensitive member No. 2 were employed. Process conditions was set to satisfy the following developing condition.

| | |
|---|---|
| Developing bias | −300 V (DC component only) |

Image printing was conducted on 500 sheets, but there was a considerable amount of residual toner after transfer. There occurred ghost image because of the residual toner interfering the exposure of Photosensitive member No. 2, and fogging due to insufficient recovery of the toner. The evaluation results are shown in Table 4.

Reproduction of isolated single dots 100 μm or smaller in diameter was insufficient, and scattering was apparent with line images. The evaluation results are shown in Table 4.

COMPARATIVE EXAMPLE 3

Image formation and evaluation was conducted in the same manner as in Example 1, except that Toner A was replaced with a toner made in the same manner as with Toner A but inorganic fine powder material was not added. From the beginning, the image density was as light as 0.8 due to the faulty toner transfer, and uneven image density was observed in the solid black areas due to faulty toner feeding. In addition, there was much of not-transferred residual toner, ghosting due to shading of exposure of the photosensitive member, and fogging due to insufficient recovery of the toner was observed. The developing conditions are shown in Table 3 and the evaluation results are shown in Table 4.

Figure 4:
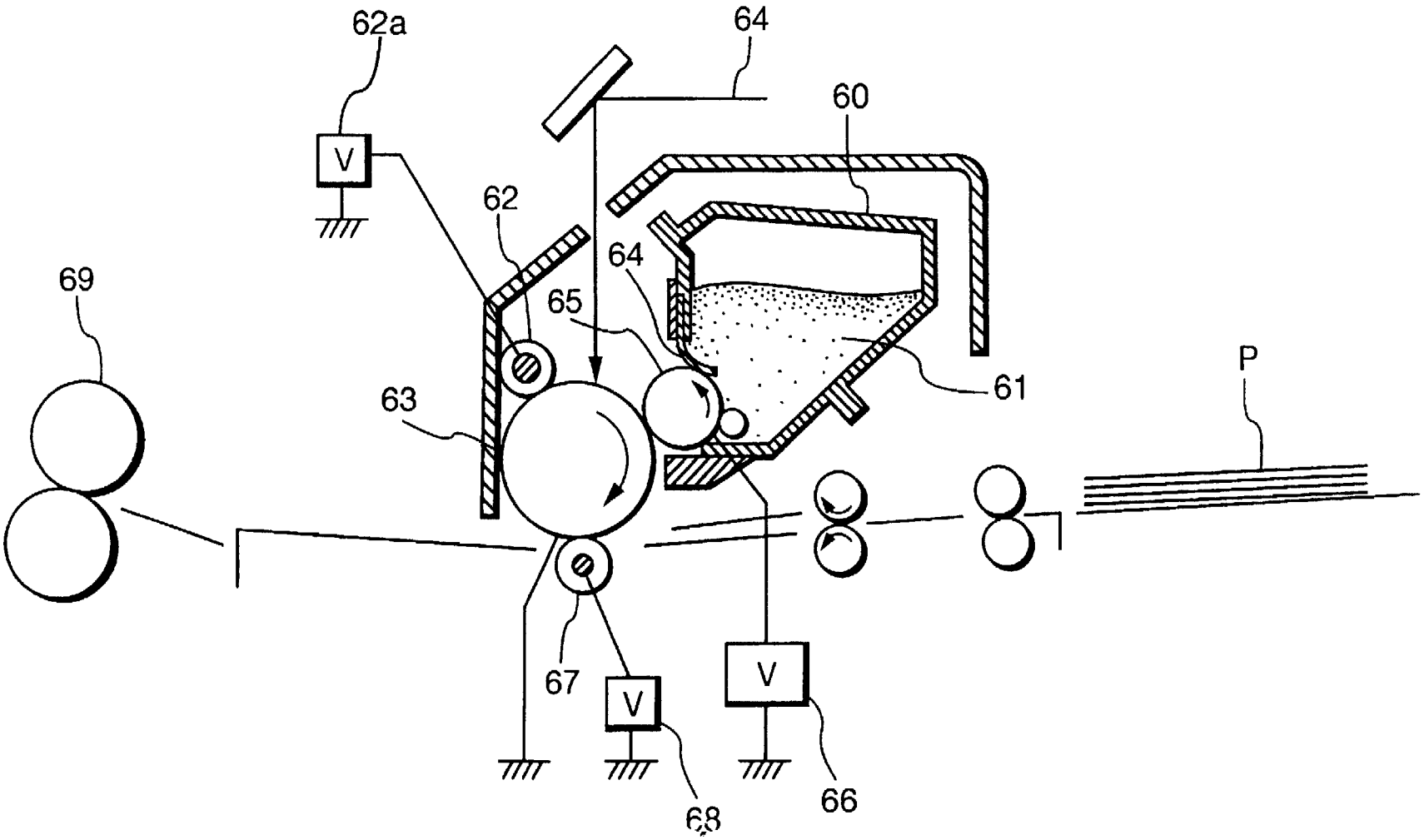

As can be clearly seen from the above, the toner in the present invention prevents excessive toner deposit on the line images, and also attains great reductions in toner consumption amount since the toner remaining after transfer is recovered in the developing process at an excellent efficiency, thereby providing high quality images with little scattering or fogging steadily, while maintaining reproduction of minute latent images. Further, the processing cartridge can be made smaller if the processing cartridge illustrated in FIG. 3 is modified cleanerless as in the processing cartridge illustrated in FIG. 4.

MANUFACTURING EXAMPLE OF LIQUID LUBRICATING AGENT-CARRYING LUBRICATING FINE PARTICLES

Lubricating fine particles A carrying a liquid lubricating agent were obtained as follows: while agitating the carrier particles (silica), a liquid lubricant-carrier, in a Henschel Mixer, a liquid lubricating agent diluted with n-hexane was dripped therein. After addition, pressure was reduced to remove the n-hexane with stirring, and then the resultant material was pulverized using a hammer mill to give a liquid lubricating agent-carrying, fine particles A. Using the same method, various liquid lubricating agents were held on various carrier particles. The physical properties of the resultant liquid lubricating agent-carrying lubricating fine powder A and B are shown in Table 5.

MANUFACTURING EXAMPLE OF LIQUID LUBRICATING AGENT-CARRYING MAGNETIC SUBSTANCE

Processed magnetic substance A carrying a liquid lubricating agent was obtained as follows: 100 parts by weight of magnetic iron oxide (BET value 7.8 $m^2/g$, $\sigma_s$=60.5 $Am^2/kg$ (emu/g)) and a predetermined amount of a liquid lubricating agent were put into a Simpson Mixer-mailer (MPVU-2, manufactured by Matsumoto Chuzo), processed at room temperature for 30 minutes, then further broken up by means of a hammer mill to give a magnetic substance A carrying a liquid lubricating agent. Using the same method, various liquid lubricating agents were held on various magnetic substances. The physical properties of the resultant processed magnetic substances A and B carrying liquid lubricating agent are shown in Table 5.

TONER MANUFACTURING EXAMPLE J

Polyester resin:

87 wt %

Liquid lubricating agent-carrying lubricating fine powder A:

2 wt %

Metal salt of salicylic acid derivative:

2 wt %

Carbon black:

6 wt %

Polyolefin:

3 wt %

After the above materials were dry-mixed, the mixture was kneaded in a twin-screw extruder set at 150° C. The obtained kneaded material was cooled, and pulverized using an air jet pulverizer, classified by means of a multi-division classifier, so that non-magnetic toner particles of a particle diameter of 8.3 μm with a desired particle distribution were obtained. Silica fine powder with BET specific surface area of 200 $m^2/g$, the surface thereof treated with hexamethyldisilazane, were added in an amount of 1.5% by weight to the obtained toner particles, thereby formulating Toner J.

TONER MANUFACTURING EXAMPLE K

Toner particles were manufactured in the same manner as in Manufacturing example J. The obtained toner was mixed in an amount of 98.5 wt % with 1.5 wt % of hydrophobic silica fine powder (BET 200 $m^2/g$) of which surface thereof is treated with hexamethyldisilazane and dimethyl silicone oil, thereby obtaining a toner of a weight average particle diameter of 8.3 μm.

TONER MANUFACTURING EXAMPLE L

Toner particles of weight average particle diameter of 8.5 μm were manufactured in the same manner as in Manufacturing example J, except for employing lubricating particles B.

TONER MANUFACTURING EXAMPLE M

Styrene-acrylic resin
84 wt %
Azo pigment containing metal
3 wt %
Liquid lubricating agent-carrying magnetic substance A
10 wt %
Low-molecular polyolefin
3 wt %

Toner M was obtained by first obtaining toner particles of average particle diameter of 7.1 μm by weight in the same manner as with Manufacturing example J, which was then mixed with silica fine powder of BET specific surface area of 200 $m^2/g$ in the amount of 2.0% by weight, the surface thereof having been treated with hexamethyldisilazane. The obtained magnetic toner M was mixed with ferrite carrier (average particle diameter 50 μm) in the ratio 5:100 to prepare a developer.

TONER MANUFACTURING EXAMPLE N

Toner N was obtained by mixing hydrophobic colloidal silica particles (BET 200 $m^2/g$), the surface thereof having been treated with dimethylsilicone, in the amount of 2.5 wt % with the magnetic toner particles in the amount of 97.5 wt % formulated in the same manner as in Manufacturing example M, thereby obtaining magnetic toner particles N of average particle diameter of 7.0 μm by weight. A developer was manufactured by mixing the obtained magnetic toner particles N with magnetic ferrite carrier (average particle diameter 50 μm) in a ratio of 5:100.

TONER MANUFACTURING EXAMPLE O

A magnetic toner of average particle diameter of 6.8 μm by weight and a developer were manufactured in the same manner as in Manufacturing example M, except for employing octahedron magnetite magnetic substance B of which surface had been treated with 1.8 wt % of methylphenyl silicone, instead of the magnetic substance A.

The physical properties of the obtained toners J through O are shown in Table 6.

EXAMPLE 10

A laser beam printer (LBP-860: Manufactured by CANON) was used as an electrophotographic apparatus. The processing speed thereof was 47 mm/s. The cleaning rubber blade in the processing cartridge of this printer was removed, and the charging assembly for the photosensitive member was replaced with a corona charger.

Next, the developing assembly in the processing cartridge was modified. Instead of a stainless steel sleeve, a rubber roller of medium resistivity (16 mm in diameter) possessing a metal core therein and a layer of foamed urethane thereon was used as the toner carrying member, and brought into contact with the photosensitive member. The toner carrying member was rotated at a peripheral speed of 120% of the peripheral speed of the photosensitive member, in the same rotational direction at the point of contact.

As a means of applying toner to the toner carrying member, an applying roller was provided, and brought into contact with the toner carrying member. Further, a resin-coated stainless steel blade was provided so as to control the toner layer on the toner carrying member. The imposed voltage at developing was made to be only of DC component (−400 V). The charge potential of the photosensitive member was standardized to −800 V for the dark are potential and −100 V for the light area potential.

The electrophotographic apparatus was modified and processing conditions thereof were determined so as to be appropriate for thus modified processing cartridge.

With the modified apparatus, the photosensitive member was uniformly charged, using the corona charging unit. Following charging, an electrostatic latent image was formed by means of exposing the image area with laser beam, which is formed into a toner image by means of reverse developing method with toner, followed by the toner image being transferred to the transfer material by means of the transfer roller to which voltage was imposed, and then the toner image was subsequently fixed to the transfer material by application of heat and pressure. I.

Photosensitive member No. 4 was employed for the photosensitive member, and Toner J was employed for the toner. The exposure strength on the photosensitive member to form a latent image was set at 4 grades, as shown in Tables 7 and 8. These grades were determined as follows: the inclination of the straight line connecting Vd and (Vd+Vr)/2 of the photosensitive characteristic curve of the photosensitive member was calculated (Vd being dark area potential and Vr being residual potential), and then a point of the photosensitive characteristic curve having an inclination of 1/20 of above determined inclination was determined to know the exposure strength of the point. 0.35 $cJ/m^2$ is smaller than the exposure strength at the point, 0.80 $cJ/m^2$ is greater than 5 times of the half exposure strength; and two exposure strength between the above two. The light area potential was approximately −100 V when the exposure strength was 0.50 $cJ/m^2$, which was standardized.

The evaluation results of ghost phenomenon are shown in Table. 7. Further, isolated dot reproducibility and gradation reproducibility were excellent, as shown in Table 8.

Concerning toner adhesion, there was no soiling of the image with the toner even after 2000 intermittent printouts, and no toner adhesion was observed on the photosensitive member either, as shown in Table 9. Further, while slight toner adhesion was observed on the photosensitive member at 4000 printouts, no soiling of the image due to toner adhesion occurred on the printed image itself.

METHOD OF EVALUATION

Concerning toner adhesion on the electrostatic latent image carrying member, a letter pattern of 4% print area was printed intermittently on 1000 sheets, 2000 sheets, and 4000 sheets, whereby evaluation of image soiling on the printed image and toner adhesion on the photosensitive member was conducted.

The results thereof are shown in Table 3. The smaller the reflection difference, the better the ghost level is.

Figure 10:
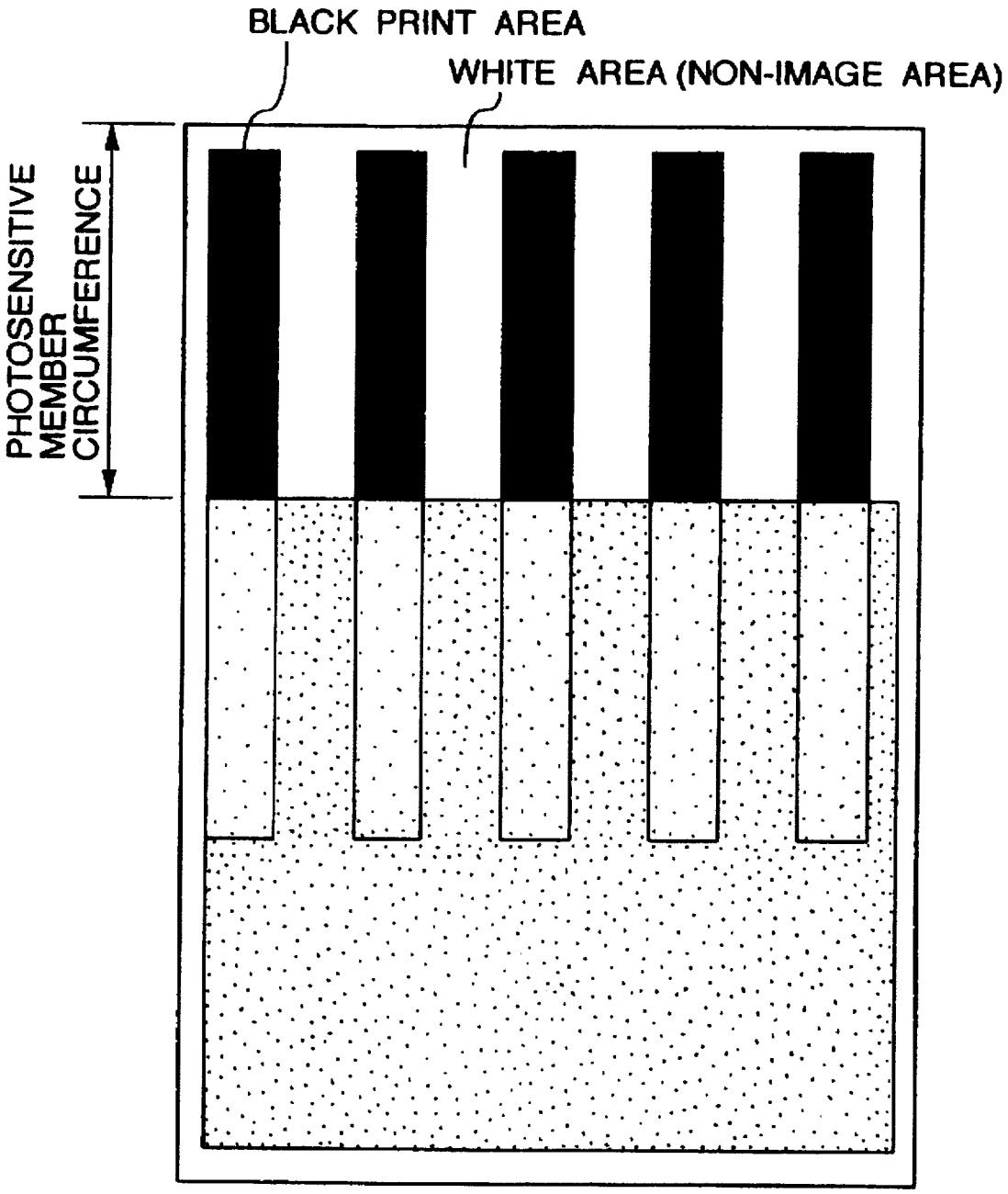
FIGS. 10 and 11 are drawings illustrating image patterns used for evaluation.

Evaluation of the ghost image was conducted using an output pattern which forms solid black stripes in the white area starting from the top end, corresponding to one rotation of the photosensitive member, and then fills the remaining area with half tone image comprised of one dot lines and two dots spaces. The outline of the pattern is shown in FIG. 10.

For the transfer material, plain paper of 75 g/m$^2$, a double weight paper of 130 g/m$^2$, and overhead projector film were used. The evaluation was carried out by taking the difference of the reflection density between the areas of the second rotation of the photosensitive member corresponding to the image-area (printed portion) and the area where no print image was formed (non-printed area) during the first rotation of the photosensitive member, using a Macbeth reflection density meter. The reflection density difference is calculated by subtracting the reflection density of the area corresponding to the non-image area from the reflection density of the area corresponding to the image area. The smaller the reflection difference, the better the ghost level is. The results are shown in Table 3.

Figure 12:
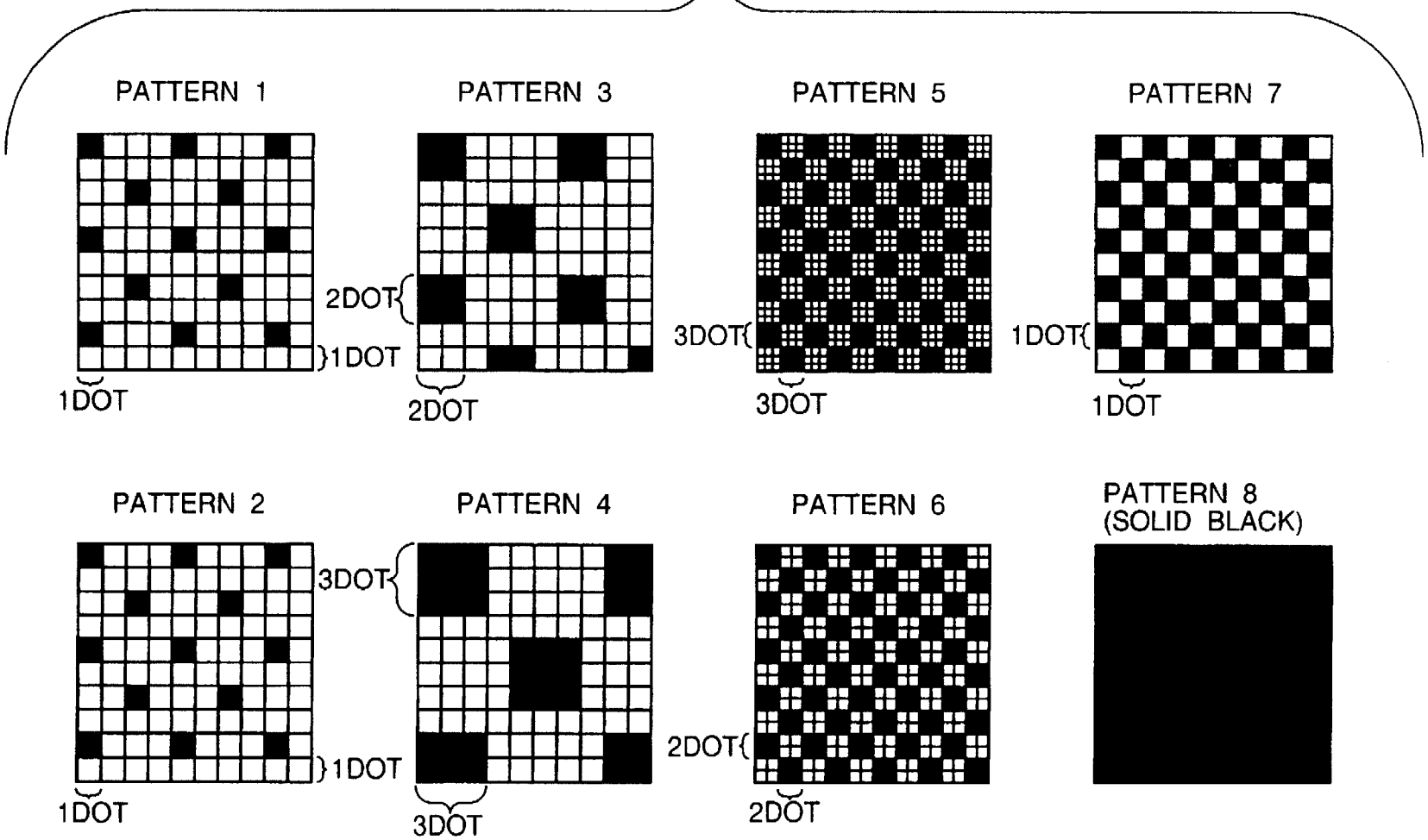
FIG. 12 is a drawing illustrating Pattern 1 to Pattern 8 of image patterns used for evaluation.

The gradation reproducibility was evaluated by measuring the image density of 8 different patterns as illustrated on FIG. 12.

From the point of gradation reproducibility, it is preferable that the desirable density ranges of each of the patterns be as shown below; so evaluation was conducted from this point of view.

Pattern 1: 0.10–0.15 Pattern 2: 0.15–0.20

Pattern 3: 0.20–0.30 Pattern 4: 0.25–0.40

Pattern 5: 0.55–0.70 Pattern 6: 0.65–0.80

Pattern 7: 0.75–0.90 Pattern 8: 1.35–

The standard employed for determination was as follows: that which met all the above ranges was ranked as excellent; that which failed in one, as good; that which failed in two or three, as fair; and that which failed in four or more was ranked as non-passable. The results thereof are shown in Table 4.

For the reproducibility of single dot of a graphical image the density of pattern 1 was evaluated. This is because the more that an electrostatic latent image becomes blurred, the wider the developing area becomes and density increases. The determination standard was set at: 0.10–0.15 being excellent; 0.16–0.17 being fair, and 0.18-being non-passable.

EXAMPLE 11

Evaluation was conducted in the same manner as in Example 10, except for employing Toner K.

As a result, while slight ghost was observed on the OHP film, there was none observed on the thick paper of 130 g/m$^2$ or thin paper of 75 g/m$^2$, as shown in Table 7. The isolated dot reproducibility and gradation reproducibility thereof was excellent, as shown in Table 8. Further, concerning toner adhesion, this embodiment was even better than Example 10, as shown in Table 9, with no toner adhesion on the photosensitive member even at time of 4000 sheets copying, and there was no soiling of the image due to toner adhesion occurring on the printed image itself.

EXAMPLE 12

Evaluation was conducted in the same manner as in Example 11, except for employing Toner L.

As a result, excellent properties approximately equal to those of Example 11 were exhibited concerning ghosting, isolated dot reproducibility, gradation reproducibility, and toner adhesion.

EXAMPLE 13

Evaluation was conducted in the same manner as in Example 11, except for employing Photosensitive member No. 5 having a protective layer in which polytetrafluoroethylene powder is dispersed, as the photosensitive member.

The evaluation results of ghosting are shown in Table. 7. Further, isolated dot reproducibility and gradation reproducibility were excellent, as shown in Table 8. Further, concerning toner adhesion, this embodiment was even better than Example 1, as shown in Table 9, with no toner adhesion on the photosensitive member even at 4000 sheets, and there was no soiling of the image due to toner adhesion occurring on the printed image itself.

EXAMPLE 14

A laser beam printer (LBP-8 Mark IV: Manufactured by CANON) was prepared as an electrophotographic apparatus. The processing speed thereof is 47 mm/s. The cleaning rubber blade in the processing cartridge of this printer was taken out. The charging method is direct charging, wherein a rubber roller is brought into contact. The voltage imposed was set at DC component (−1400 V).

Next, the developing assembly in the processing cartridge was modified. Instead of the stainless steel sleeve which is the toner-supplying member, a roller (16 mm in diameter), comprised of a multi-polar magnet roller of which surface conductivity processing was conducted and then wrapped with mid-resistance rubber of foamed urethane, was used as the carrying member, and brought into contact with the photosensitive member. The toner carrying member was driven so as to have peripheral speed of 200% of the peripheral speed of the photosensitive member, with the rotational direction thereof being the same at the point of contact.

Further, a stainless steel blade coated with resin was provided so as to control the toner layer on the toner carrying member. The imposed voltage at the time of developing was made to be only of DC component (−400 V).

The charge potential of the photosensitive member was set at −800 V for the dark area potential and −100 V for the light area potential.

The electrophotographic apparatus was modified and processing conditions thereof were set, so as to be appropriate for these modifications made to the processing cartridge.

With the modified apparatus, the photosensitive member was uniformly charged, using the roller charging assembly (imposing of DC component only). The apparatus possesses the following process: following charging, an electrostatic latent image is formed by means of exposing the image area with laser beam, which is converted into a visible image with toner, and thereafter the toner image is transferred to the transfer material by means of the transfer roller to which voltage is imposed.

Photosensitive member No. 4 was employed for the photosensitive member, and the developer containing Toner N was employed for the developer. The exposure strength on the photosensitive member to form a latent image was set at 4 grades, as shown in Tables 7 and 8. These grades were determined as follows: the inclination of the straight line connecting Vd and (Vd+Vr)/2 of the photosensitive characteristic curve of the photosensitive member was calculated (Vd being dark area potential and Vr being residual potential), and then a point of the photosensitive characteristic curve having an inclination of 1/20 of above determined inclination was determined to know the exposure strength of the point. 0.20 cJ/m$^2$ is smaller than the exposure strength at the point, 3.10 cJ/m$^2$ is greater than 5 times of the half exposure strength; and two exposure strength between the above two. The light area potential was approximately −150 V when the exposure strength was 2.80 cJ/m$^2$, which was standardized.

As illustrated in the results of evaluation conducted in the same manner as with Example 10, which are shown in Table. 7 and 8, ghosting was minimal, and a good image with excellent isolated dot reproducibility and gradation reproducibility was obtained.

Further, there was no soiling of the image from toner, nor toner adhesion observed on the photosensitive member, even after durability test of 4000 sheets.

EXAMPLE 15

Evaluation was conducted in the same manner as in Example 14, except for employing Toner N as a toner.

As a result, while slight ghost was observed on the OHP film, there was none observed on the thick paper of 130 g/m$^2$ or thin paper of 75 g/m$^2$, as shown in Table 7. The isolated dot reproducibility and gradation reproducibility thereof was also excellent. Further, concerning toner adhesion, this embodiment was even better than Example 14, as shown in Table 9, with no toner adhesion on the photosensitive member even at 4000 sheets, and there was no soiling of the image due to toner adhesion occurring on the printed image itself.

EXAMPLE 16

Evaluation was conducted in the same manner as in Example 14, except for employing Toner O in the developer. As a result, excellent properties approximately equal to those of Example 6 were exhibited concerning ghost phenomenon, isolated dot reproducibility, gradation reproducibility, and toner adhesion. See Tables 7, 8, and 9.

TABLE 1

| | Photosensitive member No. 1 | Photosensitive member No. 2 (Comparative example) | Photosensitive member No. 3 | Photosensitive member No. 4 | Photosensitive member No. 5 |
|---|---|---|---|---|---|
| Dark area Potential ($V_d$) | −800 V | −800 V | −800 V | −800 V | −800 V |
| Residual Potential ($V_r$) | −20 V | −15 V | −20 V | −60 V | −60 V |
| $(Vd + V_r)/2$ | −410 V | −407.5 V | −410 V | −430 V | −430 V |
| Inclination of $V_d$ and $(V_d + V_r)/2$ | 720 Vm$^2$/cJ | 610 Vm$^2$/cJ | 700 Vm$^2$/cJ | 4,100 Vm$^2$/cJ | 3,900 Vm$^2$/cJ |
| 1/20 inclination | 36 Vm$^2$/cJ | 30.5 Vm$^2$/cJ | 34 Vm$^2$/cJ | 205 Vm$^2$/cJ | 195 Vm$^2$/cJ |
| Point of contact with 1/20 | 2.40 cJ/m$^2$ | 2.75 cJ/m$^2$ | 2.38 cJ/m$^2$ | 0.43 cJ/m$^2$ | 0.38 cJ/m$^2$ |
| 5 times the half-value exposure strength | 2.80 cJ/m$^2$ | 3.00 cJ/m$^2$ | 2.78 cJ/m$^2$ | 0.5 cJ/m$^2$ | 0.48 cJ/m$^2$ |
| Angle of contact to water | 95° | 74° | 102° | 95° | 102° |

TABLE 2

| | Weight average particle diameter $D_4$ (μm) | Volume average particle diameter $D_v$ (μm) | Toner particles of 5 μm or less in particle diameter $N_r$ (% by count) | Toner particles of 3.17 μm or less in particle diameter $N_m$ (% by count) | $N_v$ (% by volume) | $N_m/N_v$ | Toner particles of 8 μm or more in particle diameter (% by weight) | Charge of toner (μC/g) |
|---|---|---|---|---|---|---|---|---|
| Toner A | 5.1 | 4.3 | 82 | 11.2 | 3.1 | 5.23 | 2 | −48 |
| Toner B | 5.1 | 4.3 | 67 | 17.9 | 3.5 | 5.11 | ≦1 | −45 |
| Toner C | 4.4 | 3.5 | 88 | 26.0 | 7.0 | 3.71 | ≦1 | −54 |
| Toner D | 5.0 | 4.1 | 85 | 23.4 | 6.0 | 3.90 | 1 | −50 |
| Toner E | 6.8 | 6.3 | 43 | 9.1 | 0.9 | 10.11 | 19 | −30 |
| Toner F | 9.8 | 9.2 | 11 | 4.2 | 0 | ∞ | 74 | −21 |
| Toner G | 5.3 | 4.5 | 81 | 18.6 | 4.4 | 4.23 | 3 | −43 |
| Toner H | 5.3 | 4.5 | 83 | 18.4 | 4.5 | 4.09 | 2 | −40 |
| Toner I | 5.5 | 4.7 | 76 | 23.8 | 4.5 | 5.29 | 3 | −41 |

TABLE 3

| | $V_d$ | $V_1$ | $V_{DC}$ | $\lvert V_d-V_{DC}\rvert$ | $\lvert V_1-V_D\rvert$ |
|---|---|---|---|---|---|
| Embodiment 1 | −800 V | −100 V | −400 V | 400 V | 300 V |
| Embodiment 2 | −800 V | −100 V | −300 V | 500 V | 200 V |
| Embodiment 3 | −800 V | −100 V | −350 V | 450 V | 250 V |
| Embodiment 4 | −800 V | −100 V | −400 V | 400 V | 300 V |
| Embodiment 5 | −800 V | −100 V | −400 V | 400 V | 300 V |
| Embodiment 6 | −800 V | −100 V | −400 V | 400 V | 300 V |
| Embodiment 7 | −800 V | −100 V | −400 V | 400 V | 300 V |
| Embodiment 8 | −800 V | −100 V | −400 V | 400 V | 300 V |
| Embodiment 9 | −800 V | −100 V | −400 V | 400 V | 300 V |
| Comp. Example 1 | −800 V | −100 V | −400 V | 400 V | 300 V |

TABLE 3-continued

| | $V_d$ | $V_1$ | $V_{DC}$ | $\lvert V_d-V_{DC}\rvert$ | $\lvert V_1-V_D\rvert$ |
|---|---|---|---|---|---|
| Comp. Example 2 | −800 V | −100 V | −300 V | 500 V | 200 V |
| Comp. Example 3 | −800 V | −100 V | −400 V | 400 V | 200 V |

TABLE 4

| | Image density of 5 × 5 square, after 500 sheets | Scattering from 100 μm horizontal line | Resolution 50 μm dot | Resolution 100 μm dot | Toner consumption (g/sheet) | 10-dot line width (μm) | Ghost evaluation 75 g/m² paper | Ghost evaluation 130 g/m² paper | Ghost evaluation OHP film |
|---|---|---|---|---|---|---|---|---|---|
| Example 1 | 1.45 | ○ | ○ | ○ | 0.022 | 430 | 0.00 | 0.00 | −0.01 |
| Example 2 | 1.44 | ○ | ○ | ○ | 0.025 | 430 | 0.00 | 0.00 | 0.00 |
| Example 3 | 1.47 | ○ | ○ | ○ | 0.030 | 430 | 0.00 | 0.00 | −0.01 |
| Example 4 | 1.396 | ○ | ○ | ○ | 0.024 | 420 | 0.00 | 0.00 | 0.00 |
| Example 5 | 1.45 | ○ | ○ | ○ | 0.024 | 430 | 0.00 | 0.00 | −0.01 |
| Example 6 | 1.47 | Δ | Δ | ○ | 0.029 | 440 | 0.00 | 0.00 | −0.02 |
| Example 7 | 1.39 | ○ | ○–Δ | ○ | 0.021 | 410 | 0.00 | 0.00 | −0.01 |
| Example 8 | 1.37 | ○ | ○–Δ | ○ | 0.021 | 410 | 0.00 | 0.00 | −0.01 |
| Example 9 | 1.45 | ○ | ○–Δ | ○ | 0.023 | 430 | 0.00 | 0.00 | −0.01 |
| Comparative example 1 | 1.37 | ○ | ○ | ○ | 0.025 | 410 | 0.00 | −0.02 | −0.05 |
| Comparative example 2 | 1.40 | X | X | Δ–X | 0.031 | 440 | −0.01 | −0.06 | −0.09 |
| Comparative example 3 | 0.65 | X | X | X | — | 360 | −0.01 | −0.09 | −0.12 |

Evaluation of Scattering and Resolution
○: Extremely good
Δ: good
X: apparent Scattering

TABLE 5

| | Carrier particles Type | Carrier particles BET (m²/g) | Liquid lubricating agent Type | Liquid lubricating agent Viscosity (cSt) | Liquid lubricating agent Carrying amount (wt %) |
|---|---|---|---|---|---|
| Lubricating particles A | Dry silica | 200 | Dimethyl silicon | 50000 | 60 |
| Lubricating particles B | Titanium oxide | 50 | Methyl-phenyl silicon | 10000 | 50 |
| Magnetic substance A | Spherical magnetite | 7.8 | Dimethyl silicon | 1000 | 1.2 |
| Magnetic substance B | Octahedron magnetite | 11 | Methyl-phenyl silicon | 300 | 1.8 |

TABLE 6

| | Weight average particle diameter $D_4$ (μm) | Volume average particle diameter $D_v$ (μm) | * Nr (% by count) | Toner particles of 3.17 μm or less in particle diameter: Nm (% by count) | Nv (% by volume) | Nm/Nv | Toner particles of 8 μm or more in particle diameter (% by weight) | Charge amount of Toner (μC/g) |
|---|---|---|---|---|---|---|---|---|
| Toner J | 8.3 | 7.2 | 24 | 5.6 | 0.2 | 28.0 | 55 | −32 |
| Toner K | 8.3 | 7.3 | 22 | 5.4 | 0.2 | 27.0 | 57 | −35 |
| Toner L | 8.5 | 7.4 | 20 | 5.0 | 0.2 | 25.0 | 60 | −34 |
| Toner M | 7.1 | 6.2 | 35 | 6.8 | 0.5 | 13.6 | 25 | −35 |
| Toner N | 7.0 | 6.2 | 37 | 7.0 | 0.5 | 14.0 | 24 | −44 |
| Toner O | 6.8 | 6.0 | 40 | 7.6 | 0.6 | 12.7 | 21 | −27 |

* Toner particles of 5 μm or less in particle diameter

TABLE 7

Ghost evaluation

| | Photosensitive member | Exposure strength ($cJ/m^2$) | Toner | Ghost image evaluation: 75 $g/m^2$ paper | 130 $g/m^2$ paper | 200 $g/m^2$ paper | OHP film |
|---|---|---|---|---|---|---|---|
| Example 10 | No. 4 | 0.35 | J | 0.00 | −0.01 | −0.03 | −0.05 |
| | | 0.50 | | 0.00 | 0.00 | −0.01 | −0.02 |
| | | 0.65 | | 0.00 | 0.00 | 0.00 | −0.01 |
| | | 0.80 | | 0.00 | 0.00 | 0.00 | 0.00 |
| Example 11 | No. 4 | 0.50 | K | 0.00 | 0.00 | 0.00 | 0.00 |
| Example 12 | No. 4 | 0.50 | L | 0.00 | 0.00 | 0.00 | −0.02 |
| Example 13 | No. 5 | 0.50 | J | 0.00 | 0.00 | 0.00 | 0.00 |
| Example 14 | No. 4 | 2.20 | M | 0.00 | 0.00 | −0.01 | −0.03 |
| | | 2.50 | | 0.00 | 0.00 | 0.00 | −0.01 |
| | | 2.80 | | 0.00 | 0.00 | 0.00 | −0.01 |
| | | 3.10 | | 0.00 | 0.00 | 0.00 | 0.00 |
| Example 15 | No. 4 | 2.80 | N | 0.00 | 0.00 | 0.00 | −0.01 |
| Example 16 | No. 4 | 2.80 | O | 0.00 | 0.00 | 0.00 | −0.02 |

TABLE 8

Gradation reproducibility evaluation

| | Photo-sensitive member | Exposure strength ($cJ/m^2$) | Toner | Isolated dot reproducibility evaluation | Gradation reproducibility evaluation | Density of patterns: 1 | 2 | 3 | 4 | 5 | 6 | 7 | 8 |
|---|---|---|---|---|---|---|---|---|---|---|---|---|---|
| Example 10 | No. 4 | 0.35 | J | Excellent | Excellent | 0.13 | 0.17 | 0.24 | 0.28 | 0.57 | 0.67 | 0.85 | 1.44 |
| | | 0.50 | | Excellent | Excellent | 0.15 | 0.18 | 0.27 | 0.32 | 0.61 | 0.73 | 0.89 | 1.45 |
| | | 0.65 | | Excellent | Excellent | 0.14 | 0.18 | 0.25 | 0.28 | 0.57 | 0.67 | 0.85 | 1.44 |
| | | 0.80 | | Fair | Good | 0.17 | 0.19 | 0.27 | 0.35 | 0.64 | 0.78 | 0.89 | 1.47 |
| Example 11 | No. 4 | 0.50 | K | Excellent | Excellent | 0.14 | 0.17 | 0.25 | 0.29 | 0.59 | 0.67 | 0.85 | 1.44 |
| Example 12 | No. 4 | 0.50 | L | Excellent | Excellent | 0.15 | 0.18 | 0.27 | 0.32 | 0.61 | 0.73 | 0.89 | 1.45 |
| Example 13 | No. 5 | 0.50 | J | Excellent | Excellent | 0.13 | 0.16 | 0.24 | 0.27 | 0.57 | 0.67 | 0.82 | 1.44 |
| Example 14 | No. 4 | 2.20 | M | Excellent | Excellent | 0.13 | 0.17 | 0.24 | 0.33 | 0.58 | 0.67 | 0.78 | 1.38 |
| | | 2.50 | | Excellent | Excellent | 0.14 | 0.19 | 0.25 | 0.34 | 0.60 | 0.71 | 0.79 | 1.40 |
| | | 2.80 | | Excellent | Excellent | 0.15 | 0.17 | 0.26 | 0.33 | 0.60 | 0.70 | 0.83 | 1.41 |
| | | 3.10 | | Fair | Good | 0.18 | 0.20 | 0.27 | 0.34 | 0.62 | 0.74 | 0.86 | 1.44 |
| Example 15 | No. 4 | 2.80 | N | Excellent | Excellent | 0.14 | 0.18 | 0.26 | 0.33 | 0.60 | 0.72 | 0.80 | 1.42 |
| Example 16 | No. 4 | 2.80 | O | Excellent | Excellent | 0.14 | 0.19 | 0.27 | 0.34 | 0.65 | 0.78 | 0.89 | 1.45 |

TABLE 9

Evaluation of toner adhesion

| | Photosensitive member | Exposure strength | Toner | Evaluation of toner adhesion: 500 Sheets | 1,000 Sheets | 2,000 Sheets | 4,000 Sheets |
|---|---|---|---|---|---|---|---|
| Embodiment 10 | No. 4 | 0.50 | J | ○ | ○ | ○ | Δ |
| | | | | ○ | ○ | ○ | ○ |
| Embodiment 11 | No. 4 | 0.50 | K | ○ | ○ | ○ | ○ |
| | | | | ○ | ○ | ○ | ○ |
| Embodiment 12 | No. 5 | 0.50 | L | ○ | ○ | ○ | Δ |
| | | | | ○ | ○ | ○ | ○ |
| Embodiment 13 | No. 1 | 0.50 | J | ○ | ○ | ○ | ○ |
| | | | | ○ | ○ | ○ | ○ |
| Embodiment 14 | No. 4 | 2.80 | M | ○ | ○ | ○ | Δ |
| | | | | ○ | ○ | ○ | ○ |
| Embodiment 15 | No. 4 | 2.80 | N | ○ | ○ | ○ | ○ |
| | | | | ○ | ○ | ○ | ○ |
| Embodiment 16 | No. 4 | 2.80 | O | ○ | ○ | ○ | Δ |
| | | | | ○ | ○ | ○ | ○ |

(Note)
Upper row: toner adhesion to photosensitive member
Lower row: soiling of image due to toner adhesion
Evaluation
○: no toner adhesion/no image soiling
Δ: slight toner adhesion/image soiling but practically passable

What is claimed is:

1. An image forming method comprising:

(a) charging a photosensitive member;

(b) exposing the charged photosensitive member, thereby forming an electrostatic latent image;

(c) contacting a toner or a two-component developer carried by a toner carrying member with the photosensitive member surface, thereby developing the electrostatic latent image and forming a toner image upon the photosensitive member;

(d) transferring the toner image upon the photosensitive member to a transfer material; and (e) recovering residual toner remaining upon the photosensitive member after the transfer step (d) to the toner carrying member simultaneous with a contacting step (c) wherein no additional cleaning step for removing the residual toner is conducted between the transfer step (d) and the charging step (a)

the angle of contact of the surface of the photosensitive member with water is 85° or greater; the toner is comprised of at least toner particles comprising a binder resin and a coloring agent, and an inorganic fine powder; and the toner has an average particle diameter by volume DV (μm) in a range of 3 μm≦DV≦8 μm, average particle diameter by weight D4 (μm) in a range of 3.5 μm≦D4≦9 μm, and the percentage of particles of which particle diameter is smaller than 5 μm in particle diameter distribution by number (Nr) is in a range of: 17% by number≦Nr≦90% by number.

2. The method according to claim 1, wherein the angle of contact of the surface of the photosensitive member with water is 90° or greater.

3. The method according to claim 1, wherein the surface layer of the photosensitive member contains a fluorine-containing lubricating powder.

4. The method according to claim 1, wherein the toner has an average particle diameter by volume DV (μm) in a range of 3 μm≦DV<6 μm, an average particle diameter by weight D4 (μm) in a range of 3.5 μm≦D4<6.5 μm, and the percentage of particles of which particle diameter is smaller than 5 μm in the particle diameter distribution by number (Nr) is in a range of 60% by number<Nr≦90% by number.

5. The method according to claim 1 or 4, wherein the toner has the percentage of toner particles of which diameter is 3.17 μm or smaller in the particle size number distribution (Nm) and the percentage of toner particles of which particle diameter is 3.17 μm or smaller in the particle size volume distribution (Nv) and the ratio of Nm/NV being 2.0 to 8.0, and the volume percentage of particles of which particle diameter is 8 μm or greater in volume particle distribution is 10% by volume or less.

6. The method according to claim 5, wherein the ratio of Nm/NV is 3.0 to 7.0.

7. The method according to claim 1, wherein the inorganic fine powder is selected from a group comprised of titania, alumina, silica, and double oxides thereof.

8. The method according to claim 1 or 7, wherein the surface of the inorganic fine powder is treated with a lubricating agent which is a liquid at room temperature.

9. The method according to claim 8, wherein the surface of the inorganic fine powder is treated with a silicone oil.

10. The method according to claim 1, wherein the toner has a triboelectric property that the triboelectric charge quantity (Q) against powdery iron carrier is 14 to 80 mC/kg in absolute value.

11. The method according to claim 10, wherein the toner has triboelectric property that the triboelectric charge quantity (Q) against powdery iron carrier is 24 to 60 mC/kg in absolute value.

12. The method according to claim 1, wherein the toner possesses a lubricating substance.

13. The method according to claim 12, wherein the toner comprises toner particles containing at least a binder resin, a liquid lubricating agent and a coloring agent, and an organo-treated inorganic fine powder, the toner possessing the liquid lubricating agent on the surface thereof.

14. The method according to claim 13, wherein the coloring agent carries a liquid lubricating agent.

15. The method according to claim 13, wherein the coloring agent is a magnetic substance.

16. The method according to claim 13, wherein the liquid lubricating agent is contained in the toner particles in a form of lubricant particles which contains the lubricating agent at a percentage of 20 to 90% by weight of the total weight of the lubricating particles.

17. The method according to claim 13, wherein the viscosity of the liquid lubricating agent is 100,000 cSt to 200,000 cSt at 25° C.

18. The method according to claim 12, wherein the toner comprises toner particles containing at least a binder resin and a coloring agent, and an organo-treated inorganic fine powder and a solid lubricating fine powder.

19. The method according to claim 13, wherein the surface of the inorganic fine powder is treated with at least a silicone oil or silicone varnish.

20. The method according to claim 1, wherein the electrostatic latent image is formed by exposure strength which is not more than exposure strength corresponding to a point of contact where a straight line having an inclination of 1/20 of the inclination of the straight line connecting a dark area potential Vd, on an exposure strength-surface photosensitive potential property curve of the photosensitive member, and the average of the dark area potential Vd and residual potential Vr (Vd+Vr)/2, meets the exposure strength-surface photosensitive potential property curve, and not more 5 times the half-value exposure strength.

21. The method according to claim 20, wherein the half-value exposure strength of the photosensitive member is 0.5 $cJ/m^2$ or less.

22. The method according to claim 1, wherein the photosensitive member is an OPC photosensitive member containing a phthalocyanine pigment.

23. The method according to claim 1, wherein the electrostatic latent image is developed by a reverse developing method.

24. The method according to claim 23, wherein the photosensitive member possesses the dark area potential Vd and light area potential Vl, and the DC bias VDC is imposed to the toner carrying member so as to satisfy the conditions of ■Vd−VDC■>■Vl−VDC■.

25. The method according to claim 24, wherein the DC bias VDC possesses a voltage between the dark area potential Vd and light area potential Vl.

26. The method according to claim 24, wherein the absolute value ■Vd−VDC■ is 10 V or more larger than the absolute value ■Vl−VDC■.

27. The method according to claim 1, wherein the toner is non-magnetic toner and the electrostatic latent image is developed by a non-magnetic one-component developing method.

28. The method according to claim 1, wherein the toner is non-magnetic toner mixed with a magnetic carrier, and the electrostatic latent image is developed by a magnetic brush developing method.

29. The method according to claim 1, wherein the toner is a magnetic toner.

30. The method according to claim 1, wherein the toner image is transferred to the transfer medium by a pressing transfer means to which a bias is imposed.

31. The method according to claim 1, wherein the toner carrying member is rotated at a peripheral speed faster than the peripheral speed of the photosensitive member.

32. The method according to claim 31, wherein the toner carrying member is rotated at a peripheral speed not less than 110% of the peripheral speed of the photosensitive member.

33. An image forming apparatus comprising:

a charging means for charging a photosensitive member;

an exposure means for exposing the charged photosensitive member, thereby forming a electrostatic latent image;

a developing means where a toner or a two-component developer carried by a toner carrying member is brought into contact with the photosensitive member surface, thereby developing the electrostatic latent image and forming a toner image upon the photosensitive member;

a transfer means for transferring the toner image upon the photosensitive member to a transfer material;

wherein said developing means possesses cleaning means for removing residual toner remaining on the photosensitive member to the toner carrying member; wherein no cleaning member is spaced between the transfer means and the charging means for removing the residual toner; the angle of contact of the surface of the photosensitive member with water is 85° or greater; the toner is comprised of at least toner particles comprising a binder resin and a coloring agent, and an inorganic fine powder; and the toner has an average particle diameter by volume DB (μm) in a range of 3 μm≦DV≦8 μm, average particle diameter by weight D4 (μm) in a range of 3.5 μm≦D4≦9 μm, and the percentage of particles of which particle diameter is smaller than 5 μm in particle diameter distribution by number (Nr) is in a range of: 17% by number≦Nr≦90% by number.

34. The apparatus according to claim 33, wherein the angle of contact of the surface of the photosensitive member with water is 90° or greater.

35. The apparatus according to claim 33, wherein the surface layer of the photosensitive member contains a fluorine-containing lubricating powder.

36. The apparatus according to claim 33, wherein the toner has an average particle diameter by volume DV (μm) in a range of 3 μm≦DV<6 μm, an average particle diameter by weight D4 (μm) in a range of 3.5 μm≦D4<6.5 μm, and the percentage of particles of which particle diameter is smaller than 5 μm in the particle diameter distribution by number (Nr) is in a range of 60% by number<Nr≦90% by number.

37. The apparatus according to claim 33 or 36, wherein the toner has the percentage of toner particles of which particle diameter is 3.17 μm or smaller in the particle size number distribution (Nm) and the percentage of toner particles of which particle diameter is 3.17 μm or smaller in the particle size volume distribution (Nv) and the ratio of Nm/NV being 2.0 to 8.0, and the volume percentage of particles of which particle diameter is 8 μm or greater in volume particle distribution is 10% by volume or less.

38. The apparatus according to claim 37, wherein the ratio of Nm/NV is 3.0 to 7.0.

39. The apparatus according to claim 33, wherein the inorganic fine powder is selected from a group comprised of titania, alumina, silica, and double oxides thereof.

40. The apparatus according to claim 33 or 39, wherein the surface of the inorganic fine powder is treated with a lubricating agent which is a liquid at room temperature.

41. The apparatus according to claim 40, wherein the surface of the inorganic fine powder is treated with a silicone oil.

42. The apparatus according to claim 33, wherein the toner has a triboelectric property that the triboelectric charge quantity (Q) against powdery iron carrier is 14 to 80 mC/kg in absolute value.

43. The apparatus according to claim 42, wherein the toner has triboelectric property that the triboelectric charge quantity (Q) against powdery iron carrier is 24 to 60 mC/kg in absolute value.

44. The apparatus according to claim 33, wherein the toner possesses a lubricating substance.

45. The apparatus according to claim 44, wherein the toner comprises toner particles containing at least a binder resin, a liquid lubricating agent and a coloring agent, and an organo-treated inorganic fine powder, the toner possessing the liquid lubricating agent on the surface thereof.

46. The apparatus according to claim 45, wherein the coloring agent carries a liquid lubricating agent.

47. The apparatus according to claim 45, wherein the coloring agent is a magnetic substance.

48. The apparatus according to claim 45, wherein the liquid lubricating agent is contained in the toner particles in a form of lubricant particles which contains the lubricating agent at a percentage of 20 to 90% by weight of the total weight of the lubricating particles.

49. The apparatus according to claim 45, wherein the viscosity of the liquid lubricating agent is 100,000 cSt to 200,000 cSt at 25° C.

50. The apparatus according to claim 44, wherein the toner comprises toner particles containing at least a binder resin and a coloring agent, and an organo-treated inorganic fine powder and a solid lubricating fine powder.

51. The apparatus according to claim 45, wherein the surface of the inorganic fine powder is treated with at least a silicone oil or silicone varnish.

52. The apparatus according to claim 33, wherein the photosensitive member is an OPC photosensitive member containing a phthalocyanine pigment.

53. The apparatus according to claim 33, wherein the transfer means is imposed with a bias, and located to press the transfer medium to the photosensitive member.

* * * * *

UNITED STATES PATENT AND TRADEMARK OFFICE

CERTIFICATE OF CORRECTION

PATENT NO. : 5,731,122

DATED : March 24, 1998

INVENTOR(S) : SATOSHI YOSHIDA ET AL.

It is certified that error appears in the above-identified patent and that said Letters Patent is hereby corrected as shown below:

COLUMN 4

Line 22, "and" should read --an--.

COLUMN 5

Line 35, "control" should read --controlling--.
Line 52, "releaseability" should read --releasability--.

COLUMN 6

Line 22, "1m" should read --1μm--.
Line 43, "these" should read --this--.
Line 49, "polyvinyl-alcohol," should read --polyvinyl alcohol--.

COLUMN 7

Line 28, "includes %" should read --include--.

COLUMN 8

Line 48, "is" should be deleted.
Line 63, "by" should read --be--.
Line 65, "powder" should read --powders--.

UNITED STATES PATENT AND TRADEMARK OFFICE

CERTIFICATE OF CORRECTION

PATENT NO. : 5,731,122

DATED : March 24, 1998

INVENTOR(S) : SATOSHI YOSHIDA ET AL.

It is certified that error appears in the above-identified patent and that said Letters Patent is hereby corrected as shown below:

COLUMN 9

Line 29, "number $N_r \leq 90\%$" should read --number $\leq N_r \leq 90\%$--.
Line 39, "toner." should read --toner--.
Line 45, "deteriorate." should read --deteriorate,--.
Line 55, "time of period," should read --period of time,--.
Line 56, "be" should read --be is--.
Line 59, "$Q \leq 14$," should read --$Q<14$,--.
Line 67, "attain" should read --attains--; and "amounts," should read --amount,--.

COLUMN 10

Line 4, "be also" should read --also be--.
Line 17, "liable" should read --liable to--.
Line 36, "polystyren;" should read --polystyrene;--.

COLUMN 11

Line 23, "micro-crystallline" should read --micro-crystalline--.

COLUMN 12

Line 3, "includes" should read --include--.
Line 65, "included" should read --included in--.

UNITED STATES PATENT AND TRADEMARK OFFICE

CERTIFICATE OF CORRECTION

PATENT NO. : 5,731,122

DATED : March 24, 1998

INVENTOR(S) : SATOSHI YOSHIDA ET AL.

It is certified that error appears in the above-identified patent and that said Letters Patent is hereby corrected as shown below:

COLUMN 13

Line 26, "mix-mailer," should read --mix-maller,--.
Line 47, "liquid the" should read --the liquid--.

COLUMN 14

Line 3, "here to" should read --to here--.

COLUMN 15

Line 9, "and" should read --are--.

COLUMN 16

Line 52, "liquid" should read --a liquid--.

COLUMN 17

Line 7, "manner," should read --manner.--.

COLUMN 18

Line 1, "and," should read --and--.
Line 6, "aminopro-" should be deleted.
Line 7, "ryl triethoxysilane," should read --aminopropyl triethoxysilane--.
Line 24, "include" should read --include:--
Line 25, "such as:" should be deleted.
Line 60, "gent," should read --agent--.

UNITED STATES PATENT AND TRADEMARK OFFICE

CERTIFICATE OF CORRECTION

PATENT NO. : 5,731,122

DATED : March 24, 1998

INVENTOR(S) : SATOSHI YOSHIDA ET AL.

It is certified that error appears in the above-identified patent and that said Letters Patent is hereby corrected as shown below:

COLUMN 19

Line 2, "acrylic resin" should read --acrylic resin,--.
Line 31, "possess" should read --possesses--.
Line 40, "$|V_d-V_{DC}|>|V_1-V_{DC}$" should read --$|V_d-V_{DC}|>|V_1-V_{DC}|$--.
Line 43, "from" should be deleted.
Line 66, "reproducability" (both occurrences) should read --reproducibility--.

COLUMN 20

Line 5, "regresing" should read --regarding--.
Line 32, "$V_d$." should read --$V_d$,--.
Line 62, "0.09 $cJ/m^2$. The" should read --0.09 $Cj/m^2$, the"--.

COLUMN 21

Line 7, "have" should read --have a--.
Line 48, "tribolectric" should read --triboelectric--.

COLUMN 23

Line 17, "ingredient" should read --ingredients--.

UNITED STATES PATENT AND TRADEMARK OFFICE

CERTIFICATE OF CORRECTION

PATENT NO. : 5,731,122

DATED : March 24, 1998

INVENTOR(S) : SATOSHI YOSHIDA ET AL.

It is certified that error appears in the above-identified patent and that said Letters Patent is hereby corrected as shown below:

COLUMN 25

Line 5, "releasing agent):" should read --(releasing agent):--.
Line 27, "system example of" should read --example system--.
Line 56, "An" should read --a--.
Col.26, Line 60, "used" should read --used.--.

COLUMN 27

Line 15, "of" should read --of a--.

COLUMN 28

Line 19, "was" should read --were--.

COLUMN 29

Line 48, "was" should read --were--.

COLUMN 30

Line 30, "agent-carrying." should read --agent-carrying--.
Line 44, "Mixer-mailer" should read --Mixer-maller--.

COLUMN 32

Line 39, "pressure. I." should read --pressure.--.

UNITED STATES PATENT AND TRADEMARK OFFICE

CERTIFICATE OF CORRECTION

PATENT NO. : 5,731,122

DATED : March 24, 1998

INVENTOR(S) : SATOSHI YOSHIDA ET AL.

It is certified that error appears in the above-identified patent and that said Letters Patent is hereby corrected as shown below:

COLUMN 33

Line 21, "image-area" should read --image area--.
Line 31, "on" should read --in--.

COLUMN 35

Line 13, "Table." should read --Table--.

COLUMN 36

Table 3, "$|V_d-V_{DC}|$" should read --$|V_d-V_{DC}|$--.

COLUMN 37

Table 3-continued, "$|V_d-V_{DC}|$" should read --$|V_d-V_{DC}|$--.

Signed and Sealed this

Fifteenth Day of December, 1998

Bruce Lehman

*Attest:*

BRUCE LEHMAN

*Attesting Officer*

*Commissioner of Patents and Trademarks*

UNITED STATES PATENT AND TRADEMARK OFFICE

CERTIFICATE OF CORRECTION

PATENT NO. : 5,731,122

DATED : March 24, 1998

INVENTOR(S) : SATOSHI YOSHIDA ET AL.

It is certified that error appears in the above-identified patent and that said Letters Patent is hereby corrected as shown below:

COLUMN 43:

Line 32, "member" should read --member for removing the residual toner--;
Line 33, "means for removing" should read --means;--; and
Line 34, "the residual toner;" should be deleted.

Signed and Sealed this

Ninth Day of January, 2001

*Attest:*

Q. TODD DICKINSON

*Attesting Officer*

*Commissioner of Patents and Trademarks*